US006113160A

United States Patent [19]

Johansson et al.

[11] Patent Number: 6,113,160

[45] Date of Patent: Sep. 5, 2000

[54] LATCH

[75] Inventors: Torsten Johansson, Eskilstuna, Sweden; Claes Magnusson, London, United Kingdom; Glenn Anderson, Malvern, Pa.; Charles Scally, Warminster, Pa.; J. Michael Wittig, West Chester, Pa.; Stefan Koveal, Glen Mills, Pa.; James H. Vickers, Middletown Township, Pa.

[73] Assignee: Southco, Inc., Concordville, Pa.

[21] Appl. No.: 09/037,101

[22] Filed: Mar. 9, 1998

[51] Int. Cl.[7] ..... E05C 1/12

[52] U.S. Cl. ..... 292/169; 292/DIG. 37

[58] Field of Search ..... 292/140, 163–165, 292/169, 169.19, 169.21, DIG. 30, DIG. 38, DIG. 64, DIG. 37, DIG. 53; 70/134, DIG. 20, 208

[56] References Cited

U.S. PATENT DOCUMENTS

| | | | |
|---|---|---|---|
| D. 312,769 | 12/1990 | Bisbing . | |
| D. 370,620 | 6/1996 | Ziemer . | |
| 372,645 | 11/1887 | Tweeddale . | |
| 462,183 | 10/1891 | Varney . | |
| 477,654 | 6/1892 | Grimes . | |
| 619,772 | 2/1899 | Martin . | |
| 682,242 | 9/1901 | Curley . | |
| 850,840 | 4/1907 | Ledford . | |
| 913,410 | 2/1909 | Marbach . | |
| 1,039,953 | 10/1912 | Kalivoda . | |
| 1,069,079 | 7/1913 | Voight . | |
| 1,853,564 | 4/1932 | Jacobi . | |
| 1,901,412 | 3/1933 | Richter . | |
| 2,120,647 | 6/1938 | Papst . | |
| 2,496,737 | 2/1950 | McCallick et al. . | |
| 2,536,295 | 1/1951 | Leonard, Sr. . | |
| 3,111,833 | 11/1963 | Dettmer . | |
| 3,122,012 | 2/1964 | Christopher . | |
| 3,222,899 | 12/1965 | Bodoh et al. . | |
| 3,234,765 | 2/1966 | Kerr . | |
| 3,438,227 | 4/1969 | Wolnaik . | |
| 3,605,200 | 9/1971 | Vallinotto et al. . | |
| 3,659,444 | 5/1972 | Wellekens . | |
| 3,671,065 | 6/1972 | Bingham | 292/175 |
| 3,786,657 | 1/1974 | Loikitz | 292/150 |
| 3,825,289 | 7/1974 | Armstrong | 292/341.13 |
| 3,830,525 | 8/1974 | Read | 292/170 |
| 3,841,674 | 10/1974 | Bisbing et al. . | |
| 3,850,464 | 11/1974 | Bisbing et al. . | |
| 3,919,866 | 11/1975 | Lipschutz . | |
| 4,115,015 | 9/1978 | Torii . | |
| 4,132,092 | 1/1979 | Steinbach . | |
| 4,193,619 | 3/1980 | Jerila | 292/168 |
| 4,435,966 | 3/1984 | Craig | 292/336.3 |
| 4,494,783 | 1/1985 | Poe | 292/155 |
| 4,552,001 | 11/1985 | Roop . | |
| 4,655,489 | 4/1987 | Bisbing . | |
| 4,689,976 | 9/1987 | Larsen . | |
| 4,978,152 | 12/1990 | Bisbing . | |
| 5,180,201 | 1/1993 | Hauber . | |
| 5,346,266 | 9/1994 | Bisbing . | |
| 5,467,619 | 11/1995 | Stillwagon . | |
| 5,551,737 | 9/1996 | Clavin | 292/169 |

FOREIGN PATENT DOCUMENTS

| | | |
|---|---|---|
| 804199 | 7/1936 | France . |

OTHER PUBLICATIONS

Caravan Beschlage Katalog (Hafele, Germany) pp. 8–10 (at least as early as Dec. 5, 1997).

Southco Latches and Access Hardware North America Edition—48 NA, (Southco, Inc., Concordville, Pennsylvania) pp. G–6, G–8, G–9, G–16 and G–18 (1998).

*Primary Examiner*—B. Dayoan
*Assistant Examiner*—Gary Estremsky
*Attorney, Agent, or Firm*—Paul & Paul

[57] ABSTRACT

A latch secures a first member such as a door panel against a second member such as a corresponding frame. The latch comprises a housing for mounting in the first member, a pawl adapted for engaging a keeper in a latched position on the second member and latch actuating means for selectively moving the pawl into a position away from the keeper in order to allow the first member to be opened.

28 Claims, 30 Drawing Sheets

LATCH

FIELD OF THE INVENTION

The present invention relates to latches for fastening doors, panels and the like.

BRIEF DESCRIPTION OF THE PRIOR ART

There are numerous types of latches known in the art for fastening doors, panels and the like. Many types incorporate an actuator within the latch design in order to provide latch operation. One example of such prior art devices is illustrated in U.S. Pat. No. 4,556,244 ('244 patent) to Robert H. Bisbing and assigned to Southco, Inc., the assignee of the present application, the entire disclosure of which is hereby incorporated by reference herein. The '244 patent discloses a compression latch incorporating an actuator in the form of a handle and a pawl operable through rotation of the handle in order to move the pawl between latched and unlatched positions.

Another type of latch incorporating an actuator within the latch design is termed a slam-action latch. The slam-action principal has been widely used in the prior art and has been embodied in various latch designs, which usually incorporate a housing which encloses several components, one of which is a sliding-bolt element or pawl. The general characteristic of this type of latch is that it is activated to secure a first member, such as a door, by cooperation of a striker or keeper mounted on a second member, such a door frame, when the door is merely pushed shut or slammed, but some operation of the latch mechanism is required to release the latch and open the door. Examples of such types of latches are illustrated in U.S. Pat. Nos. 3,850,464 ('464 patent) and 3,841,874 ('874 patent) each to James H. Vickers and Robert H. Bisbing and assigned to Southco, Inc., the assignee of the present invention, the entire disclosures of which are herein incorporated by reference. The '464 and '874 patents each disclose a spring-loaded bolt element or pawl having a cam surface cooperating with a striker surface on the door frame as the door is moved into a closed position. The spring force thereafter urges the bolt element or pawl to engage behind the door frame or to engage a keeper element provided on the door frame. In order to open the door when latched against the cabinet frame, a hand grip is provided on the housing to operate the mechanism which withdraws the end of the bolt element from engagement with the door frame or the keeper.

Examples of additional types of slam latches are illustrated in U.S. Pat. Nos. 4,978,152 ('152 patent) and D312,769 ('769 patent), each to Robert H. Bisbing and assigned to Southco, Inc., the assignee of the present invention, the entire disclosures of which are hereby incorporated by reference. The '152 and '769 patents each disclose various types of opening actions of an actuator, such as twisting of a knob or a key or pushing a knob or other activation means, to provide retraction of the pawl in order to unfasten the latch and allow the door to be pulled open away from the frame.

There have been certain drawbacks noted in the foregoing types of prior art fasteners. One noted disadvantage in some prior art devices is that the handle projects outwardly from the enclosure to which the latch is mounted, which can cause unwanted operation of the latch through inadvertent contact on the handle by an operator or other structure. Also, in some instances, such types of latches are considered less desirable for aesthetic reasons since the handle is readily visible.

Another drawback noted with prior art slam latches that have a push-button as the latch actuator is that the knob or other push-button is required to be in an extended position in order to close the door. Also, such designs typically employ a mechanical spring to provide the push-to-open and push-to-close action.

Still another drawback observed in some prior art devices is that one or more flats is required to be incorporated into the housing of the latch and which is received into a correspondingly configured mounting hole to prevent unwanted rotation, which requires significant panel preparation.

In addition, another drawback noted in the prior art is that in operation a person can be trapped inside of an enclosure since the latch actuator is positioned on the opposite side of the latch.

Still another disadvantage noted with prior art latches is attributed to the relationship between the bolt element or pawl and keeper. In particular, latching is accomplished as the pawl engages behind the keeper, which requires precise placement of the pawl relative to the keeper or cabinet frame in order to provide proper latch engagement.

Another noted disadvantage with prior art slam latches is that the pawl may not properly latch when the door is not pushed with a sufficient enough force.

Another noted drawback in the prior art is that there is no way to regulate the amount of holding force supplied by the latch.

Still another noted drawback in the prior art is that such latches when secured can become unlatched due to inadvertent contact force or vibration.

Still another drawback noted with prior art devices is that assembly of the separate components can be rather time consuming or cumbersome in order to retain the various elements.

The present invention has been developed in view of the foregoing and to overcome the deficiencies of the prior art.

SUMMARY OF THE INVENTION

In accordance with the present invention, a latch is disclosed comprising a housing, a latching member within the housing for movement between latched and unlatched positions and latch actuating means for selectively moving the pawl into the unlatched position.

It is therefore an object of the present invention to provide a latch incorporating an actuator capable of being stowed away in a retracted position so as to assume a low-profile.

It is another object of the present invention to provide a slam-action latch having a push-button type of latch actuator in which latching of the pawl with the keeper can occur either with the push-button in an extended or a retracted position.

It is a further object of the present invention to provide a slam-action latch incorporating a pawl moveable into a partially retracted position when locked and which provides a user-friendly means to actuate the pawl.

Another object of the present invention is to provide a latch incorporating a pawl adapted to engage a keeper in a latched position and in which precise placement of the keeper is not required to provide proper engagement with the pawl and also which accommodates for some misalignment of the pawl with the keeper and/or the respective members to which the latch carrying the pawl and the keeper are attached.

Still a further object of the present invention is to provide a latch capable of being non-rotatably mounted in a member such as a door panel without requiring significant preparation of the mounting hole.

Still a further object of the present invention is to provide a slam-action latch which provides for a quick and simplified assembly.

It is a still further object of the present invention to provide a latch incorporating an actuator moveable between extended and retracted positions in which the parts are few and which are sufficiently durable in operation.

These and other features, objects and advantages of the present invention will become more readily apparent when taken into consideration with the following description and attached drawings.

BRIEF DESCRIPTION OF THE FIGURES

FIGS. 56*a*–56*d* are fragmentary sectional views enlarged showing positions of a cam and cam follower of FIG. 55.

DETAILED DESCRIPTION OF THE PREFERRED EMBODIMENTS

Figure 1:
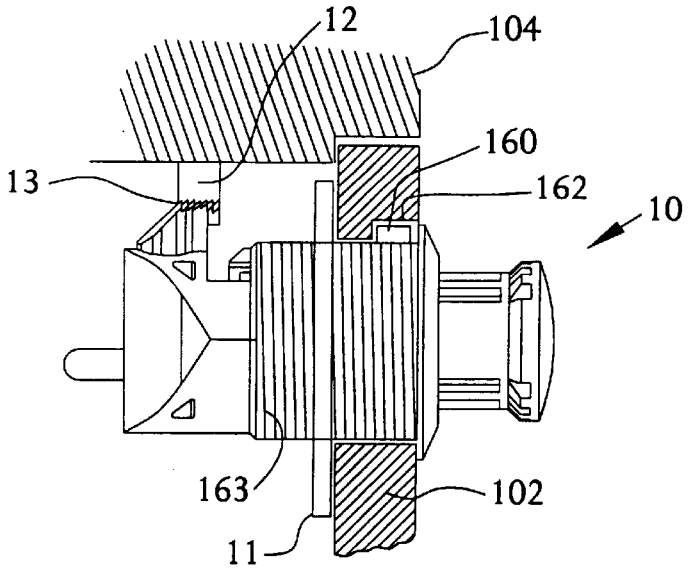
FIG. 1 is an elevational view of a latch in accordance with an embodiment of the present invention comprising a slam latch illustrated mounted in a portion of a first member shown in section and in a latched position against a keeper mounted to a portion of a second member shown in section.

Referring now to the drawings in detail, wherein like reference numerals indicate like elements throughout the several views, there is shown in FIGS. 1–14 an embodiment of a latch in accordance with the present invention. As will be described in detail herein, the features of the present invention are suitable for use with a variety of types of latching devices. In FIGS. 1–14 is illustrated one type of latch to which the features of the present invention can be applied. As best illustrated in FIG. 1, the latch 10 is of the slam-action type and is shown mounted in a portion of a first member 102 shown in section and in a latched position against a keeper 12 shown mounted to a portion of a second member 104 in section. As best illustrated in the exploded perspective view of FIG. 2, the major components of the slam latch 10 in accordance with the present embodiment comprise a housing 14, a latching member comprising a pawl 16 in the present embodiment and latch actuating means comprising a latch actuating member including an actuator comprising a handle 18 and a can or sleeve 20 in the present embodiment, the details of which will be more fully described below.

Figure 2:
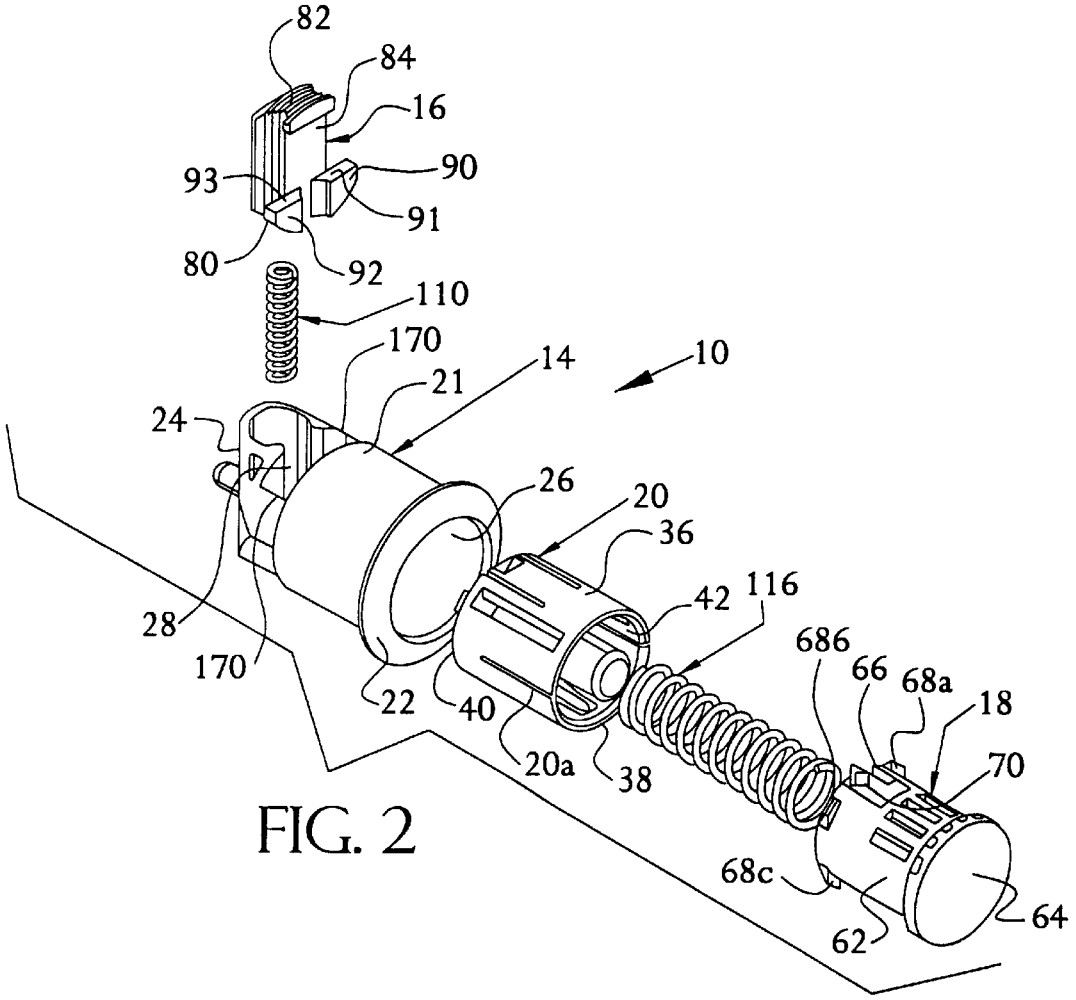
FIG. 2 is an exploded perspective view of the slam-latch of FIG. 1.
Figure 3:
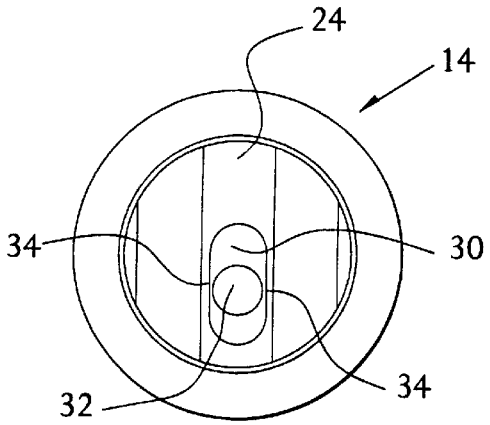
FIG. 3 is an isolated left side elevational view of a housing of FIG. 2.

The housing 14 in this embodiment is generally elongated and includes an outer surface 21, opposing upper and lower surfaces 22 and 24, respectively and a cavity 26 within the upper surface 22. The upper surface 22 in this embodiment as best shown in FIGS. 1 and 2 defines a flange adapted for seating of the housing 14 in the panel 102. As best shown in FIG. 2, the outer surface 21 of the housing 14 is substantially cylindrical in cross-section and also includes an opening 28 within its outer surface 21 which is adapted to receive the pawl 16. In this embodiment, the opening 28 and cavity 26 within the housing 14 are connected to form a continuous channel, which is best illustrated in the sectional view of FIG. 11. As best seen in the isolated left side elevational view of the housing 14 shown in FIG. 3, the housing 14 also includes a second opening 30 generally elliptical in shape and within the bottom surface 24 and extending into the opening 28 in the present embodiment. In addition, as shown in FIGS. 1–3, the housing 14 further includes an actuating member 32 generally elongated in shape positioned proximate the second opening 30 and at least one and preferably two connectors 34 in this embodiment for attaching the actuating member 32 to the housing 14. As will be described in more detailed herein, each of the two connectors 34 define a tab of sufficiently thin material so as to allow detachment of the actuating member 32 from the housing 14 upon application of suitable force on the actuating member 32.

Figure 4:
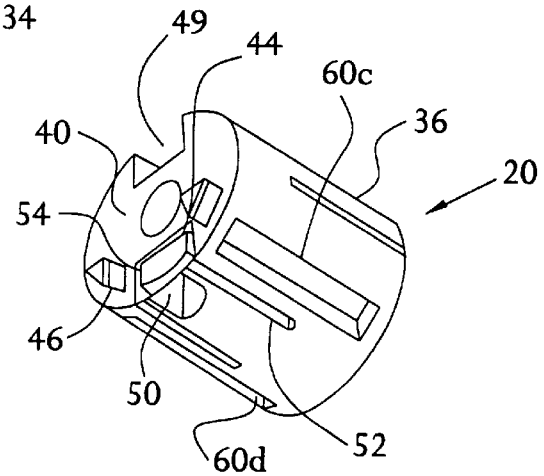
FIG. 4 is an isolated left side perspective view of a can of FIG. 2.
Figure 5:
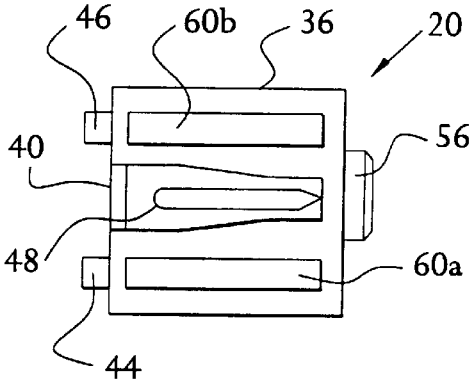
FIG. 5 is an isolated bottom plan view of the can of FIG. 4.
Figure 6:
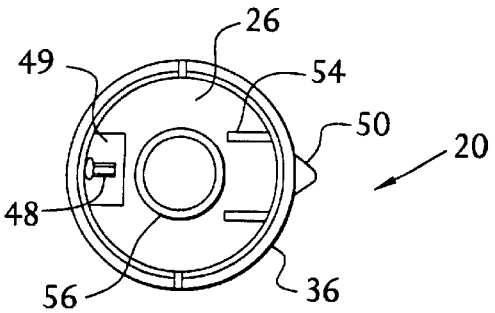
FIG. 6 is an isolated right side elevational view of the can of FIG. 4.

The can 20 as shown in FIG. 2 is generally elongated and is defined by an outer surface 36 substantially cylindrical in cross-section, opposing top and bottom surfaces 38 and 40, respectively, and a cavity 42 within the top surface 38. As best shown in the left side perspective view of FIG. 4 and bottom plan view of FIG. 5, the can 20 includes at least one and in this embodiment preferably two actuating bosses 44 and 46 defining drive members extending from the bottom surface 40. As illustrated in FIG. 4, each of the actuating bosses 44 and 46 are generally triangular in shape and include a substantially triangular shaped cavity therein extending from its terminating end to the bottom surface 40 of the can 20. As best shown in FIG. 5, the can 20 further includes in this embodiment a generally triangular shaped cut out provided within the outer surface 36 and a leg 48 generally elongated and cylindrical in cross-section positioned within the cut-out and attached to the outer surface 36 proximate the top surface 38 providing a generally flexible connection. In this embodiment, preferably the leg 48 includes a boss at its free end and is provided integrally connected at its opposite end to the outer surface 36 providing a one-piece structure, although as should be understood the leg 48 can be provided as a separate piece attached to the outer surface 36 where desired. In this embodiment, as best shown in FIG. 6, preferably a generally rectangular shaped cavity 49 is provided within the bottom surface 40 adjacent to the outer surface 36. As best shown in FIGS. 4 and 6, the can 20 further includes at least one boss comprising the boss 50 generally triangular in shape in this embodiment defined by a substantially ramped camming surface and a substantially planar locking surface attached to and extending from the outer surface 36. In addition, in this embodiment, as shown in FIG. 4, preferably the outer surface 36 includes a channel 52 extending therethrough defined by three sides surrounding the boss 50. In addition, a second channel 54 in this embodiment defined by three sides is also included within the bottom surface 40 adjacent to the boss 50. As shown in FIGS. 5 and 6, preferably the can 20 in this embodiment further includes a hollow substantially cylindrical body 56 positioned within the cavity 26 and attached to the bottom surface 40. As best shown in FIG. 5, the body 56 is generally elongated and preferably extends along a longitudinal axis out past the upper surface 38 of the can 20. As best shown in FIGS. 4 and 5, the can 20 also includes at least one and preferably a plurality of cavities 60 within the outer surface 36. In this embodiment, four cavities 60*a*–60*d* are provided within the outer surface 36 and with each of the cavities 60 being substantially rectangular in configuration and extending along a longitudinal axis of the can 20.

Figure 7:
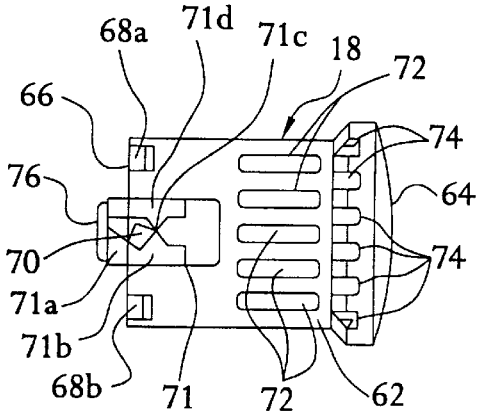
FIG. 7 is an isolated front elevational view of a handle of FIG. 2.
Figure 7A:
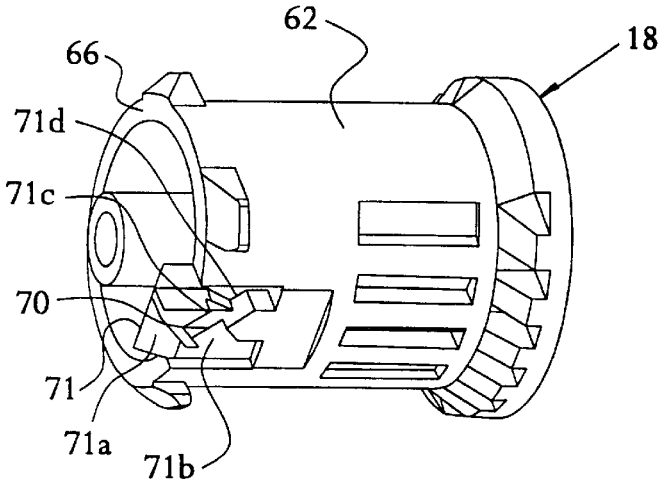
FIG. 7*a* is an enlarged isolated perspective view of the handle of FIG. 2.
Figure 8:
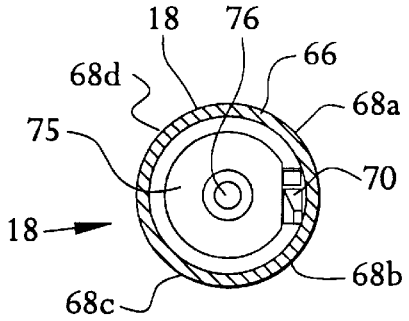
FIG. 8 is an isolated left side elevational view of the handle of FIG. 7.

The handle 18 in this embodiment is generally elongated and defined by an outer surface 62 and upper and lower end surfaces 64 and 66 as is illustrated in FIGS. 2, 7 and 8. In this embodiment, the handle 18 includes at least one and preferably a plurality of bosses comprising in the present embodiment four bosses 68*a*–68*d*. In this embodiment, each of the bosses 68*a*–68*d* are positioned proximate the lower end surface 66 and comprise a camming surface and a locking surface. As best shown in FIGS. 7 and 7*a*, the handle 18 also includes a receptacle defined by an opening 70 within its outer surface 62. In this embodiment, the opening 70 is integrated within a camming surface 71, the purpose of which will be more fully described herein. In this embodiment, preferably a portion of the outer surface 62 is generally rectangular in this embodiment extending out past the lower end surface 66 and includes a portion of the camming surface 71 therein. In addition, in this embodiment the handle 18 also includes at least one and preferably a plurality of depressions 72 at spaced separation within the outer surface 62, with each depression 72 being generally rectangular in configuration along a longitudinal axis of the handle 18. In addition, in this embodiment preferably the handle 18 includes at least one and preferably a plurality of second depressions 74 within its outer surface 62 and proximate to the upper end surface 64, with each of the second depressions 74 being sized smaller than the depression 72. In this embodiment, the depressions 72 and second depressions 74 define a gripping surface in operation. As best illustrated in FIG. 7 and 7*b*, preferably the handle 18 and further includes a cavity 75 within its bottom end surface 66 generally cylindrical in configuration and a hollow substantially cylindrical shaped body 76 positioned within the cavity 75 and attached at one end to the upper end surface 64 and extending out past the lower end surface 66. The upper end surface 64 in this embodiment is generally radiused in configuration as best shown in the elevational view of FIG. 7.

Figure 9:
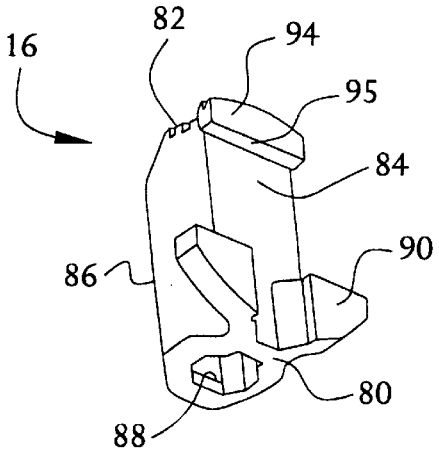
FIG. 9 is an isolated right side perspective view of a pawl of FIG. 2.
Figure 10:
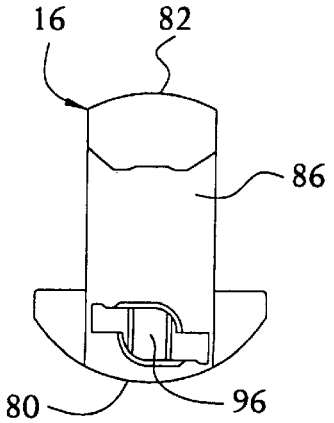
FIG. 10 is an isolated left side elevational view of the pawl of FIG. 9.

The pawl 16 as best illustrated in FIGS. 2, 9 and 10 is generally elongated along a longitudinal axis defined by inner and outer end portions 80 and 82, respectively and opposing upper and lower surface 84 and 86 at spaced separation between the inner and outer end portions 80 and 82. As best shown in FIG. 9, the pawl 16 includes a cavity 88 extending within its inner end portion 80. In addition, the pawl 16 includes at least one and preferably two walls 90 and 92 defining "wings" extending from the upper surface 84. In this embodiment, each of the two walls 90 and 92 are generally triangular in shape attached at one end to the upper surface 84 and with the remaining portion being unattached. The two walls 90 and 92 each define a substantially planar engaging surface 91 and 93 which are substantially aligned with one another. In the present embodiment, the two walls 90 and 92 are at spaced separation and positioned proximate to the inner end surface 80. In addition, located proximate the outer end surface 82 in this embodiment is a third end wall 94 having a substantially planar engaging surface 95 positioned facing the engaging surface 91 and 93 of the two walls 90 and 92. As best shown in FIG. 10, the pawl 16 further includes a receptacle 96 provided within the bottom surface 86 and extending into the cavity 88 within the inner end surface 80. In this embodiment, the receptacle 96 is generally S-shaped in configuration. As best shown in FIG. 2, the pawl 16 also includes at least one and preferably a plurality of ratcheting teeth or serrations at spaced separation and substantially parallel with one another proximate its terminating end at its outer end surface 82. In this embodiment, each of the plurality of serrations comprises a substantially ramped camming surface and a locking surface substantially perpendicular to a longitudinal axis of the pawl 16.

The housing 14, can 20, handle 18 and pawl 16 are each preferably manufactured from conventional thermosetting or thermoplastic materials, such as by injection molding, however other suitable materials and/or manufacturing process can also be used.

Figure 11:
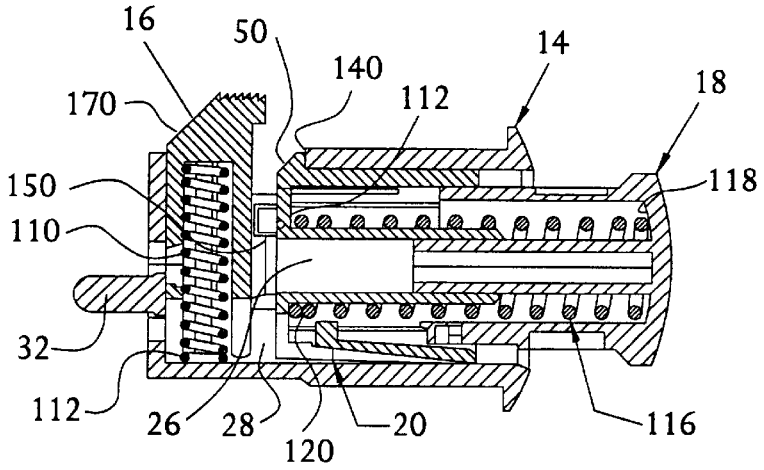
FIG. 11 is a front elevational view in section showing the slam-latch of FIG. 1, with the handle in an extended position.
Figure 12:
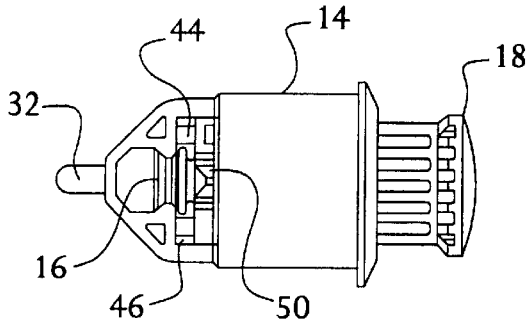
FIG. 12 is a top plan view of the slam latch of FIG. 1.

The assembly of the foregoing components of the slam latch 10 will now be described. The pawl 16 is inserted into the opening 28 in the housing 14. In this embodiment, the shape of the pawl 16 corresponds to the configuration of opening 28; in particular, a portion of the opening 28 is sized larger in order to receive the two walls 90 and 92 which extend from the upper surface 84 of the pawl 16. In addition, preferably biasing means 110 such as a conventional coil spring of metal is provided between the pawl 16 and the housing 14. In the present embodiment, the coil spring 110 as is illustrated in FIGS. 1 and 11 is inserted into the opening 88 within the pawl 16 and engages an inside wall 112 of housing 14.

The handle 18 is inserted in the cavity 42 within the can 20 and the can 20, in turn, is inserted into the cavity 26 within the housing 14. In this embodiment, the can 20 can be inserted first into the cavity 26 within the housing 14, followed then by insertion of the handle 18 in the cavity 42 within the can 20. Alternatively, the handle 18 can first be inserted into the cavity 42 within the can 20, followed then by insertion of the can 20 within the cavity 26 in the housing 14. In the present embodiment, preferably biasing means 116 such as a conventional coil spring of metal is provided between the handle 18 and the can 20. As is illustrated in FIGS. 2 and 11, in the present embodiment, one end of the coil spring is inserted around the body 76 and into the cavity 74 within the handle 18 and the second end of the coil spring 116 is inserted onto the body 56 and into the cavity 26 of the can 20. In this manner, when assembled, one end of the coil spring 116 is preferably in engagement with an inside wall 118 of the handle 18 opposite the upper end surface 64 and the second end of the coil spring 116 is in engagement with an inside wall 120 of the can 20 opposite the bottom surface 40.

As will be described in detail herein, the force exerted by the coil springs 110 and 116 work to urge the pawl 16 and handle 18 into extended positions. As should be understood, the biasing means 110 and 116 can be provided in other forms as well, such as an integral living hinge spring comprised for example of plastic.

In accordance with the present embodiment, connecting means are provided between one or both of the housing 14 and the can 20 and/or the can 20 and the handle 18 for snap-fit attachment. As will be described in detail below, in the present embodiment, the housing 14 and can 20 as well as the can 20 and handle 18 are connected by a snap-fit attachment.

In the present embodiment, the snap-fit attachment between the housing 14 and can 20 is accomplished by interaction between the boss 50 of the can 20 and end surface 140 within the outer surface 21 of the housing 14 defined by the opening 28. In the present embodiment, the surface 140 is substantially planar, although other configurations may also be provided. On assembly of the can 20 into the housing 14, the camming surface of the boss 50 initially comes into engagement with the inside wall of the housing 14 and which slightly compresses at least the boss 50 and preferably also a portion of the outer surface 36 of the can 20. As the can 20 is moved to its mounted position within the housing 14, the boss 50 is moved past the surface 140 within the outer surface 21 and into the opening 28, allowing the boss 50 to move back toward its original position and with the locking surface of the boss 50 preferably engaging the surface 140 within the housing 14, as best illustrated in FIG. 11. There can also be a locking tab which prevents the boss 50 from moving; it is moved away by a tool.

As best illustrated in FIGS. 2 and 11, on assembly of the handle 18 and can 20, the snap-fit engagement between the members is accomplished in this embodiment by the four bosses 68*a*–68*d* extending from the outer surface 62 of the handle 18 which are received into the four cavities 60*a*–60*d* provided within the outer surface 36 of the can 20. As discussed earlier in the application, while four bosses 68*a*–68*d* and four cavities 60*a*–60*d* are disclosed in the present embodiment, any desired number of bosses and cavities can be provided for the same purpose. On assembly of the handle 18 into the cavity 38 within the can 20, the camming surfaces of the four bosses 68*a*–68*d* initially engage the inside wall of the outer surface 36 of the can 20 which, similar to the boss 50 on the can 20, results in slight compression of at least the four bosses 68*a*–68*d* and also preferably a portion of the outer surface 62 of the handle 18. Thereafter, the handle 18 is then further inserted into the cavity 42 within the can 20 and positioned so as to be received into the four cavities 60*a*–60*d* within the can 20, which allows the four bosses 68*a*–68*d* to move back toward their original position. In this embodiment, the cavities 20*a*, which extend along a longitudinal axis, facilitate mounting of the handle by allowing the can 20 to slightly expand. As described earlier, preferably the coil spring 116 is positioned between the can 20 and handle 18 within the respective cavities 42 and 74.

As described earlier, the pawl 16 is assembled into the opening 28 provided within the outer surface 21 of the housing 14, and also preferably with the coil spring 110 positioned between a pawl 16 and housing 14. In the present embodiment, preferably the pawl 16 is inserted into the opening 28 within the housing 14 prior to the snap-fit engagement of the housing 14 and can 20. Specifically, in this embodiment, preferably the pawl 16 and coil spring 110 positioned within the opening 88 are inserted into the opening 28 within the housing 14. Afterward, the pawl 16 is preferably moved slightly in the direction of the housing 14 towards its retracted position, slightly compressing the coil spring 110 in order to position the substantially square shaped area on the upper surface 84, which is defined between the third end wall 94 and two walls, 90, 92 of the pawl 16, so as to receive the bosses 44 and 46 of the can 20 as the can 20 is moved to its mounted position snap-fit with the housing 14. In the present embodiment, the pawl 16 is released after the can 20 is assembled in the housing 14, walls 90 and 92 are positioned at least adjacent to and preferably in contact with the two bosses 44 and 46 of the can 20.

Figure 14:
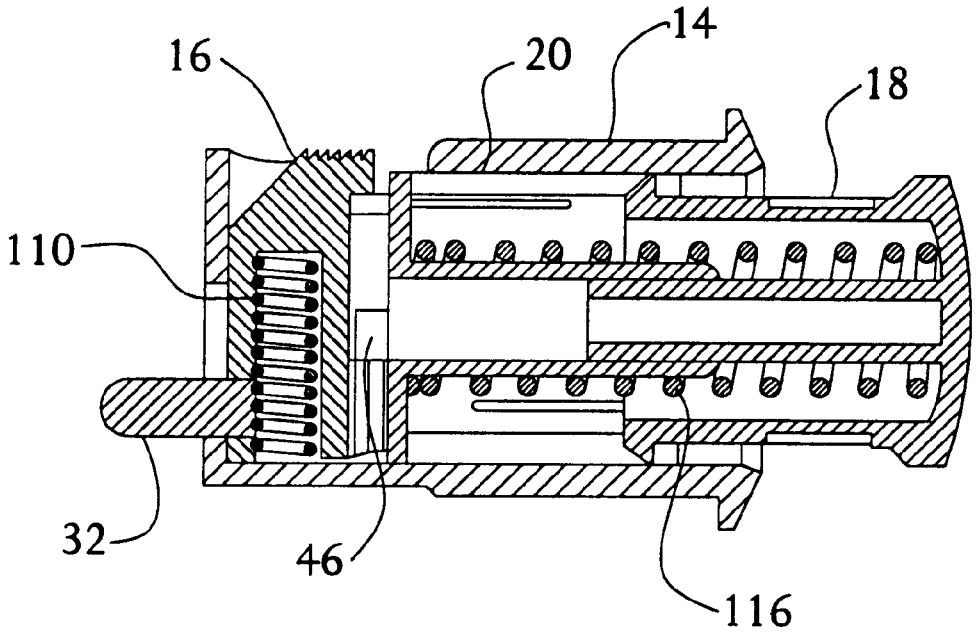
FIG. 14 is a front elevational view in section of the slam-action latch of FIG. 13 showing the handle in an extended and rotated position and the pawl in a retracted position.
Figure 15:
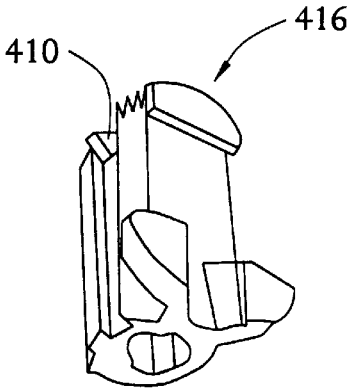
FIG. 15 is a fragmentary partially sectional perspective view illustrating an embodiment of a self-aligning pawl substituted in place of the pawl of FIG. 1.
Figure 16:
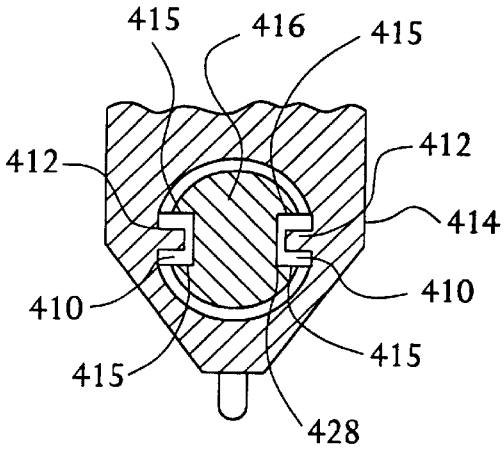
FIG. 16 is a fragmentary sectional front elevational view of the self-aligning pawl of FIG. 15 mounted in a modified housing substituted for the housing of FIG. 1.
Figure 17:
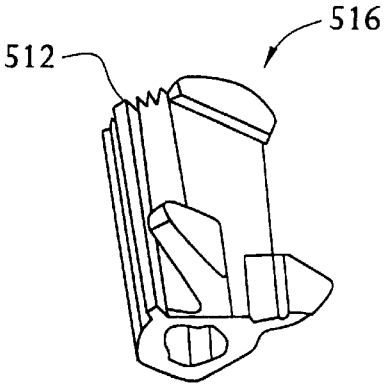
FIG. 17 is a fragmentary partially sectional perspective view illustrating a second embodiment of a self-aligning pawl substituted in place of the pawl of FIG. 1.
Figure 18:
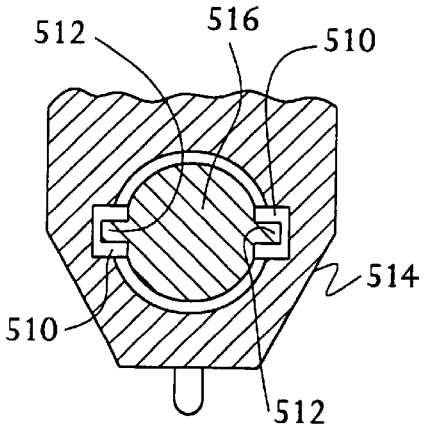
FIG. 18 is a fragmentary sectional front elevational view of the self-aligning pawl of FIG. 17 mounted in a modified housing substituted for the housing of FIG. 1.

The assembly of the various components of the slam latch 10 of the present embodiment is best illustrated in the sectional side elevational view of FIG. 11 showing the slam latch 10 in an unlatched position and with the pawl 16 and handle 18 in an extended position. In the present embodiment, the extended position of the pawl 16 due to the bias of the coil spring 110 is regulated by the engagement between the two walls 90 and 92 on the pawl 16 with the respective two bosses 44 and 46 extending from the can 20, which is illustrated in FIG. 11 at 150. Similarly, in this embodiment, the extended position of the handle 18 is regulated by the engagement of the four bosses 68*a*–68*d* with the outer ends of the cavities 60*a*–60*d* within the can 20, which is best illustrated in the sectional view of FIG. 14 showing two of the respective bosses and cavities.

The operation of the slam latch 10 in accordance with the present embodiment will now be described with reference to the first and second panel members 102 and 104 for latching against the keeper 12 as illustrated in FIG. 1. In the present embodiment, preferably the slam latch 10 is mounted within an aperture extending through the first panel member 102 in a rigid and non-rotating manner and the keeper 12 is secured in a fixed position to the second panel member 104. The first and second panel members 102 and 104 can respectively comprise, for example, a cabinet door and corresponding frame comprised substantially of wood, although it should be understood the slam latch 10 and keeper 12 can be utilized with numerous other types of enclosures and comprised of other materials as well. In this embodiment, the keeper 12 is secured to an inside surface of the frame 104 via two retaining screws extending through the two mounting apertures extending through the keeper 12. As shown in FIG. 1, the keeper 12 is generally rectangular in this embodiment and includes an engaging surface 13 defined by at least one and preferably a plurality of ratcheting teeth or serrations, each comprised of a substantially ramped camming surface and a locking surface. In the present embodiment, the slam latch 10 is secured in a non-rotating manner in the door 102 via engagement of a protrusion such as lug 160 extending from the outer surface 21 of the housing 14 and cavity such as key way 162 within the door 102 adjacent to the mounting aperture. In the present embodiment, the slam latch 10 is inserted within the aperture in door 102 so that the lug 160 is received into the key way 162. The slam latch 10 is secured to the door 102 in this embodiment by tightening mounting nut 11 relative to a threaded section 163 on the outer surface of the housing 14, so that a lower surface of the flange 22 engages an outer surface of the door 102. In the present embodiment, the axial position of the slam latch 10 is secured by the mounting nut 11 and flange 22 positioned against opposite sides of the door 102 and the rotational position of the slam latch 10 is fixed by the position of the lug 160 within key way 162. In addition, in this embodiment, the aperture through the door 102 is substantially annular in cross-section corresponding to the substantially tubular shaped outer surface 21 of the housing 14 received within the aperture, although other cross-sectional configurations of the aperture through the door 102 and/or outer surface 21 of the housing 14 can also be utilized where desired. Although not shown, the positions of the lug 160 and key way 162 may be reversed so that the protrusion is positioned within the door 102 and the key way or other shaped opening is positioned within the outer surface of the housing 14. Alternatively, where non-rotational mounting of the housing 14 is desired, a plurality of lugs/key ways may be provided or other means for providing non-rotational mounting can be used, such as having a "double D" shape on the outer surface of the housing 14 and corresponding "double D" shape in the aperture through the door 102. The housing can also have a breakaway lug 160 such that it can be mounted with a hole without a key even by slamming the housing into the hole whereby breaking the lug which falls into a cavity in the housing prepared to receive it. A lock washer used to prevent rotation if the key way is not present.

Latching of the slam latch 10 against the keeper 12 for securing the door 102 in a closed position against the frame 104 will now be described. As discussed earlier, one aspect of the present invention is that the slam latch 10 can operate to latch against the keeper 12 with the handle 18 either in its retracted or extended positions. In the present embodiment, the handle 18 when in its retracted position has its upper end surface 64 positioned substantially flush with the upper surface 22 of the housing 14. For purpose of this illustration, it will be seen that the handle 18 is in its extended position prior to latching against the keeper 12, as is illustrated in FIG. 11. As the door 102 is moved to close against the frame 104, the camming surface 170 of the pawl 116 initially comes into engagement with an edge of the keeper 12, with continued movement to the closed position resulting with the pawl 16 being moved toward its retracted position against the bias of the coil spring 110 as the keeper rides up the camming surface 170. In this embodiment, continued closing the door 102 moves the camming surface 170 past the keeper 12 and the ramped camming surface of the first ratcheting tooth on the pawl 16 comes into engagement with the substantially ramped camming surface of the first ratcheting tooth of the keeper 12. Thereafter, any continued movement of the door 102 into its closed position against the frame 104 will move one or more of the ratcheting teeth on the pawl 16 along one or more of the ratcheting teeth on the keeper 12. For example, on additional movement of the door 102 to the closed position, the camming surface of the first ratcheting tooth on the pawl 16 will come into engagement with the camming surface of the second ratcheting tooth on the keeper 12 and the camming surface of the second ratcheting tooth on the pawl 16 will come into engagement with the camming surface of the first ratcheting tooth of the keeper 12. This progression of the ratcheting teeth on the pawl 16 along the ratcheting teeth on the keeper 12 will continue until the door 102 is in the closed position against the frame 104, such as shown in FIG. 1. In FIG. 1, each of the ratcheting teeth on the pawl 16 is shown in engagement with each of the ratcheting teeth on the keeper 12, although this is not required and it should be understood that any number of ratcheting teeth on the pawl 16 can be in engagement with any number of ratcheting teeth on the keeper 12. In this embodiment, the positions of the camming and locking surfaces on the pawl 16 are substantially 180° from a position of each camming and locking surface on the keeper 12.

When the slam latch 10 is in a latched positioned against the keeper such as illustrated in FIG. 1, the engagement of the ratcheting teeth on the pawl 16 and keeper 12 provide significant holding force to retain the door 102 in its closed and latched position against the frame 104. This is accomplished in the present embodiment through the engagement of the substantially perpendicular locking surfaces on the respective pawl 16 and keeper 12. Also, the force exerted by the coil spring 110 provides additional holding force between the keeper 12 and pawl 16.

Figure 13:
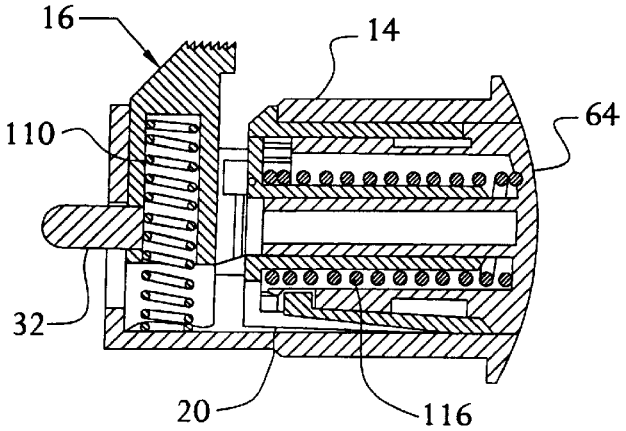
FIG. 13 is a front elevational view in section of the slam-latch of FIG. 11 showing the handle in a retracted position and supplemental latch actuating means in a fully assembled position.

Another aspect of the present invention is that the slam latch 10 when in its latched position against the keeper 12 will remain latched when the handle 18 is in its extended position or its retracted position, which provides much versatility in operation. The slam latch 10 in accordance with the present embodiment is illustrated in FIG. 13 with the handle 18 in the retracted position. So as to illustrate the movement of the handle 18 between its extended and retracted positions, movement of the handle 18 from its extended position illustrated in FIG. 11 to the retracted position in FIG. 13 will now be described. Retraction of the handle 18 is accomplished by applying a suitable pressing force such as by hand against the outer surface 64, so as to depress the handle 18 in opposition to the tension on the coil spring 116. In this embodiment, as the handle 18 is moved toward its retracted or closed position, the four bosses 68*a*–68*d* are moved within the four cavities 60*a*–60*d* within the can 20. Continued movement of the handle 18 towards its retracted position will bring the camming surface 71 into engagement with the boss of the generally flexible leg 48. As the handle 18 is depressed further into its retracted position, the boss or bearing member of the generally flexible leg 48 follows the pathway of the camming surface 71 and then engages the opening 70 within the camming surface 71 in order to retain the handle 18 in its retracted position. In this embodiment, preferably the camming surface 71 on the handle 18 is generally in the shape of an "M" and comprises a three dimensional shaped channel defining, with reference to the pathway of the leg 48, an upwardly inclined surface 71*a*, a substantially planar surface 71*b* connected with surface 71*a* terminating at opening 70, an inclined surface 71*c* extending up from the bottom surface defined by opening 70 and opposite surface 71*a*, and a substantially planar surface 71*d* adjacent to the surface 71*c* and substantially aligned with the bottom surface of opening 70, although other suitable configurations can also be utilized for the same purpose. The resiliency provided by the spring action of the generally flexible leg 48 positions the boss against the camming surface 71 and provides sufficient holding force when the boss is seated within the cam opening 70 in the retracted position of the handle 18. The flexibility of the leg 48 allows the boss to follow the pathway of the camming surface 71. In this embodiment, the generally flexible leg 48 pivots at its connection with the outer surface 36 of the can 20 when traveling within the camming surface 71. In particular, as the handle is moved from its extended position to its retracted position, the leg 48 initially pivots away from the opening 70 due to the engagement of the boss with the ramped cam surface adjacent the upwardly included surface 71*a*, and then the resiliency of the leg 48 brings it back toward center and into the opening 70 when the boss is positioned within the planar surface 71*b* and adjacent the opening 70. Similarly, as the handle is moved from its retracted position to its extended position, the leg 48 again pivots away from the opening 70, but in the opposite direction, due to engagement of the boss with the ramped cam surface adjacent the inclined surface 71*c*. The resiliency of the leg 48 then brings it back toward its original center position when the planar surface 71*d* is moved out of engagement with the boss of leg 48. In this embodiment, due to the "M" shape of the camming surface 71, the handle 18 when moved to its retracted position has its outer surface 64 initially move past the upper surface 22 and into the cavity 26 of the housing 14, followed then by the upper end surface 64 then moving back toward the upper surface 22 and into the position illustrated in FIG. 13, with the outer end surface 64 of handle 18 substantially flush with the upper surface 22 of the housing 14. In the present embodiment, the amount of retraction of the handle 18 into the cavity 26 within the housing 14 is regulated by the relationship of the four bosses 68*a*–68*d* on the handle 12 within the four cavities 60*a*–60*d* within the can 20; in particular, when the handle 18 of the slam latch 10 is in its fully retracted position, the bosses 68*a*–68*d* are positioned against the ends of the four cavities 60*a*–60*d* positioned closest to the bottom surface 40 of the can 20.

In order to extend or "pop-out" the handle 18 from its retracted position flush with the housing 14 shown in FIG. 13, a suitable amount of depressing force is again exerted upon the outer surface 64, so as to move the handle 18 further toward its retracted position within the cavity 26 of housing 14, which results with the boss on the generally flexible leg 48 initially moving out of the cam opening and then following the remaining portion of the camming surface 70. The tension on the coil spring 116 then forces the handle member 18 back out toward its extended position, such as shown in FIG. 11.

The operation for unlatching the slam latch 10 when engaging the keeper 12 shown in FIG. 1 will now be described with reference to FIG. 11. In this embodiment, unlatching can be accomplished by rotation of the handle 18 in either its clockwise or counterclockwise direction in order to move the pawl 16 toward its retracted position and away from the keeper 12. Although not shown, in other embodiments it may be desired that unlatching can only occur on rotation of the handle 18 in one direction. In the present embodiment, FIG. 14 illustrates the handle 18 rotated to its furthest counterclockwise position and retracting the pawl 16. In this embodiment, the movement of the pawl 16 to its retracted position is accomplished by the boss 46 extending from the can 20 which rotates with rotation of the handle 18 and accordingly moves the pawl 16 to its retracted position through engagement with the wall 92. Although not shown, on clockwise rotation of the handle 18, the retraction of pawl 16 would occur due to the rotational movement of the boss 44 in engagement with the wall 90 on pawl 16. When the pawl 16 is retracted away from the keeper 12, the door 102 can then be opened by a suitable pulling force on the handle 18. In the present embodiment, upon release of the rotational force on the handle 18, the force exerted by the coil spring 110 moves the pawl 16 back toward its extended position which, in turn, rotates the handle 18 back into the position illustrated in FIG. 11. In this embodiment, the boss 50 is moved against and along the length of the surface 140 in the outer surface 21 of housing 14 on rotation of the handle 18. In this embodiment, the amount of rotational movement of the handle 18 in either direction can be regulated by one or both of the engagement of the inner end portion 80 of the pawl 16 with the inner surface 112 of the housing 14, or the inner surfaces 170 shown in FIG. 2 defined by the opening 28 at the opposing ends of the surface 140 of housing 14.

Another feature of the present embodiment is that supplemental latch actuating means are provided independent of the handle 18 for selectively moving the pawl 16 into its retracted position. In this embodiment, the supplemental latch actuating means comprises the actuator 32 and receptacle 96 in the bottom surface 86 of the pawl 16. For example, from the position illustrated in FIG. 11 in which the actuating member 32 is attached with housing 14, a suitable amount of depression force against the free end of the actuator 32 in a direction of the pawl 16 will at least substantially release and preferably detach the actuator 32 from engagement with the housing 14 by the connector 34, in order that the opposing end of the actuator 32 can move into the receptacle 96 within the pawl 16. In this embodiment, the actuator 32 is secured by being press-fit within the receptacle 96 in pawl 16. Thereafter, the actuator 32 can be moved by application of a suitable force in opposition to the tension of coil spring 110 in order to move the pawl 16 toward its retracted position; for example, with reference to the latched position shown in FIG. 11, away from the keeper 12 to allow subsequent opening of the door. In this embodiment, the two walls 90 and 92 of the pawl 16 are moved away from the drive members 44 and 46 on the can 20 as the pawl 16 is moved toward the retracted position.

Although not shown, in other embodiments the actuator 32 can be attached directly to the pawl 16, for example by a screw connection or by being a single molded piece, rather than the actuator 32 being a separate piece prior to being press-fit into the pawl 16.

Figure 19:
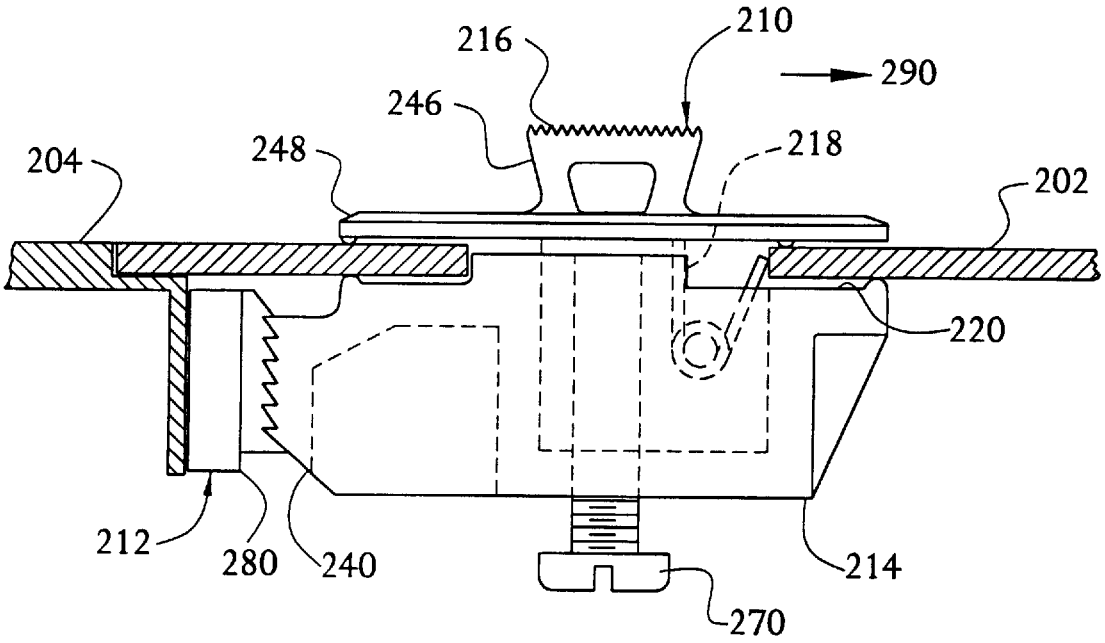
FIG. 19 is an elevational view of a latch in accordance with another embodiment of the present invention comprising a slam latch illustrated mounted in a portion of a first member shown in section and in a latched position against a keeper mounted to a portion of a second member shown in section.
Figure 20:
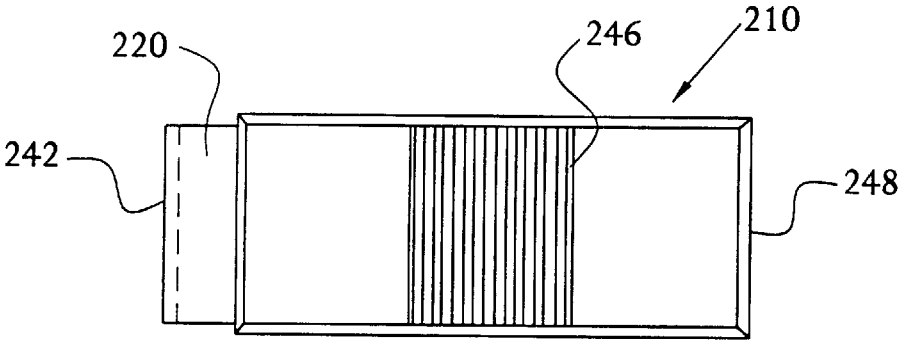
FIG. 20 is an isolated top plan view of the slam latch of FIG. 19.

In FIGS. 19–28 is shown another embodiment of a latch in accordance with the present invention. As best illustrated in FIG. 19, the latch 210 is of the slam-action type and is shown mounted in a portion of a first member 202 shown in section and in a latched position against a keeper 212 shown mounted to a portion of a second member 204 in section. In the present embodiment, the slam latch 210 includes, as portions thereof, a housing comprising a latching member 214 and latch actuating means comprising in this embodiment an actuator 216 and a biasing means 218, which in the present embodiment is of the torsion spring type. Although not shown, it should be understood that the biasing means 218 can be provided in other forms as well, such as an integral spring or living spring attached with one or both of the actuator 216 or latching member 214. In addition, while in the present embodiment the latching member 214 and actuator 216 are comprised of separate components, in other embodiments the actuator 216 and latching member 214 can be provided as a single one-piece element. The various components of the slam latch 210 will be described in more detail in the following paragraph.

Figure 21:
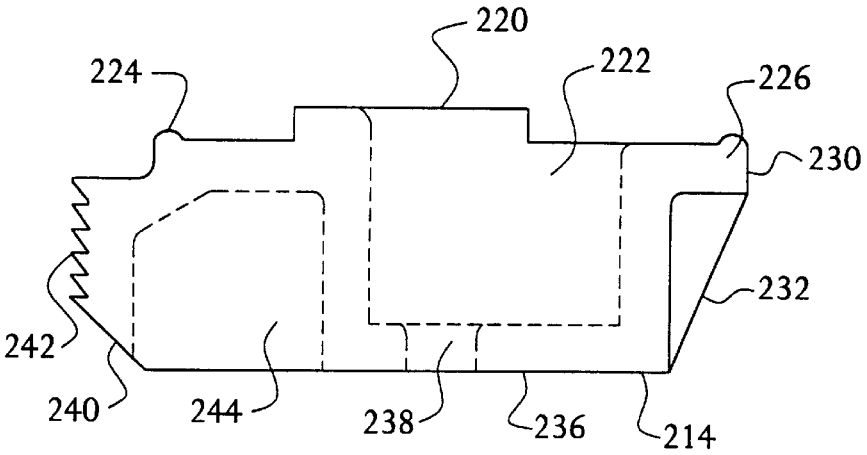
FIG. 21 is a front elevational view of a portion of the slam latch of FIG. 19 comprising a latching member.
Figure 22:
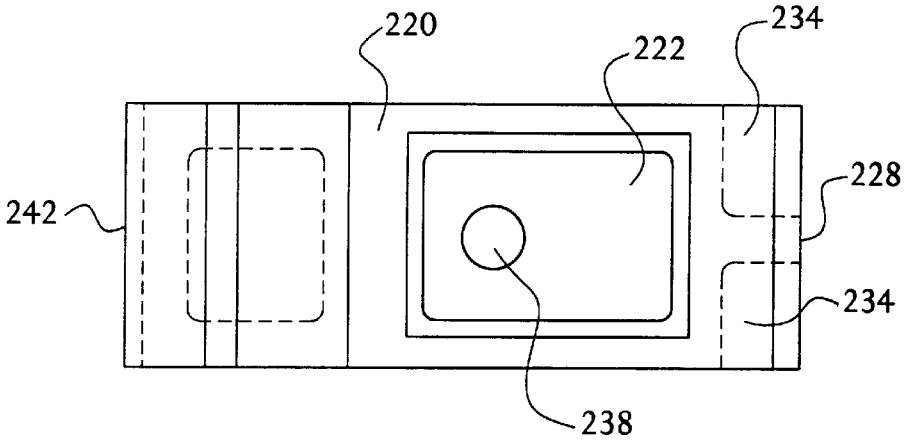
FIG. 22 is a top plan view of the latching member of FIG. 21.

The latching member 214 as illustrated in FIGS. 21 and 22 includes an upper surface 220 having a generally rectangular shaped cavity 222 therein and two bosses 224 and 226 extending from the upper surface 220 proximate opposing ends. The latching member 214 in this embodiment also include a rear surface 228 defining a substantially planar surface 230 and an angled mounting surface 232. In addition, as best illustrated in FIG. 22, in this embodiment the rear surface 228 further includes opposing substantially square shaped cavities 234 extending therein.

In addition, as shown in FIG. 21, the latching member 214 also includes a lower surface 236 substantially planar in configuration and including an aperture 238 therein generally annular in cross-section as best illustrated in FIG. 22. In this embodiment, the latch member 214 also includes a front surface defined by an angled camming surface 240 and an engaging portion 242 defining at least one and preferably a plurality of ratcheting teeth or serrations. In the present embodiment, each ratcheting tooth or serration preferably comprises a ramped camming surface and a locking surface generally elongated along a longitudinal axis of the latching member 214. As will be described in more detail herein, the engaging portion 242 is adapted to come in contact with the keeper 212 in a latched position. In this embodiment, the latching member 214 further includes a cavity 244 generally rectangular in configuration and provided within the bottom surface 236.

Figure 23:
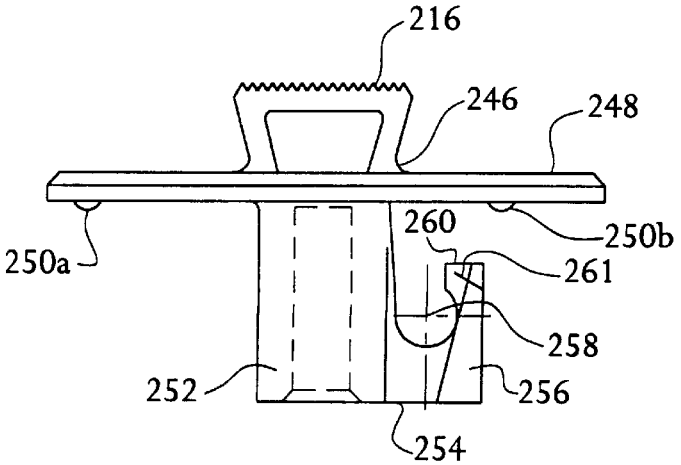
FIG. 23 is a front elevational view of a portion of the slam latch of FIG. 19 comprising an actuator.
Figure 24:
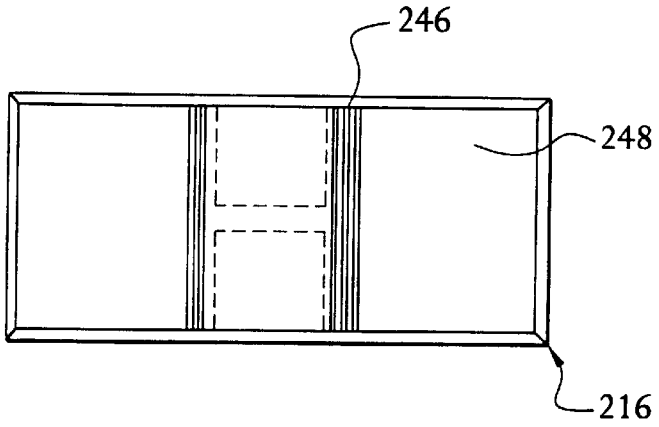
FIG. 24 is a top plan view of the actuator of FIG. 23.
Figure 25:
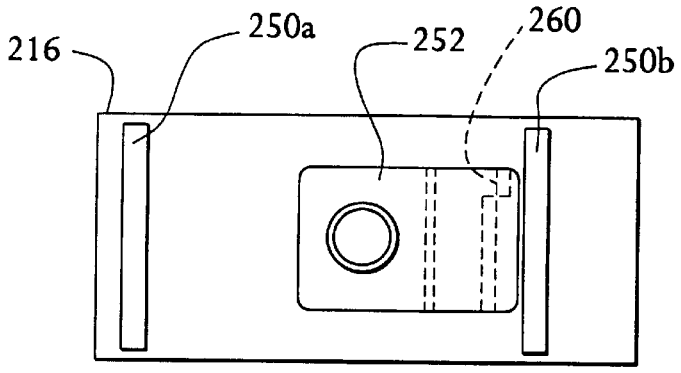
FIG. 25 is a bottom plan view of the actuator of FIG. 23.

In FIGS. 23–25 is illustrated in detail the configuration of the actuator 216 in accordance with the present embodiment. Actuator 216 includes a handle 246 generally rectangular in cross-section and attached with a substantially planar upper surface of a wall 248. As best shown in FIGS. 23 and 25, in this embodiment, the wall 248 also includes a substantially planar lower surface having a pair of generally elongated bosses 250*a* and 250*b* attached proximate opposing ends. In this embodiment, the configuration of the bosses 250*a* and 250*b* of the actuator 216 corresponds in configuration to the bosses 224 and 226 of the latching member 214. The actuator 216 in this embodiment also includes a body 252 generally rectangular in configuration and extending from the lower surface of the wall 248. In this embodiment, preferably an aperture generally cylindrical in cross-section is provided extending within a bottom surface 254 of the body 252 and terminating adjacent to the wall 248. In addition, in this embodiment, the actuator 216 also includes a platform 256 attached with one side of the body 252 and with the platform 256 including a generally cylindrical channel 258 extending within its upper surface 260 and substantially parallel to the wall 248. In addition, in this embodiment, the platform 256 further includes a stop 261 generally square in configuration adjacent to the upper surface 260 and channel 258, the purpose of which will be described below.

Figure 26:
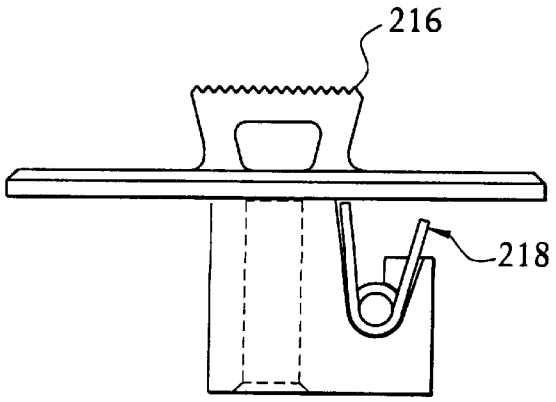
FIG. 26 is a front elevational view illustrating a portion of the slam latch of FIG. 19 comprising latch actuating means and incorporating the actuator of FIG. 23.
Figure 27:
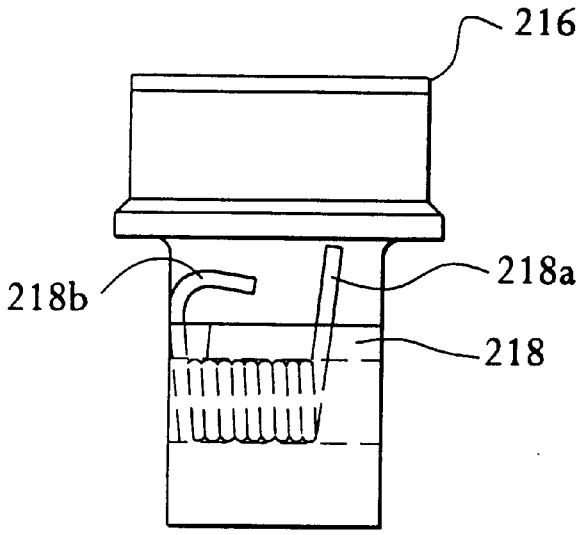
FIG. 27 is a right side elevational view of the latch actuating means of FIG. 26.
Figure 28:
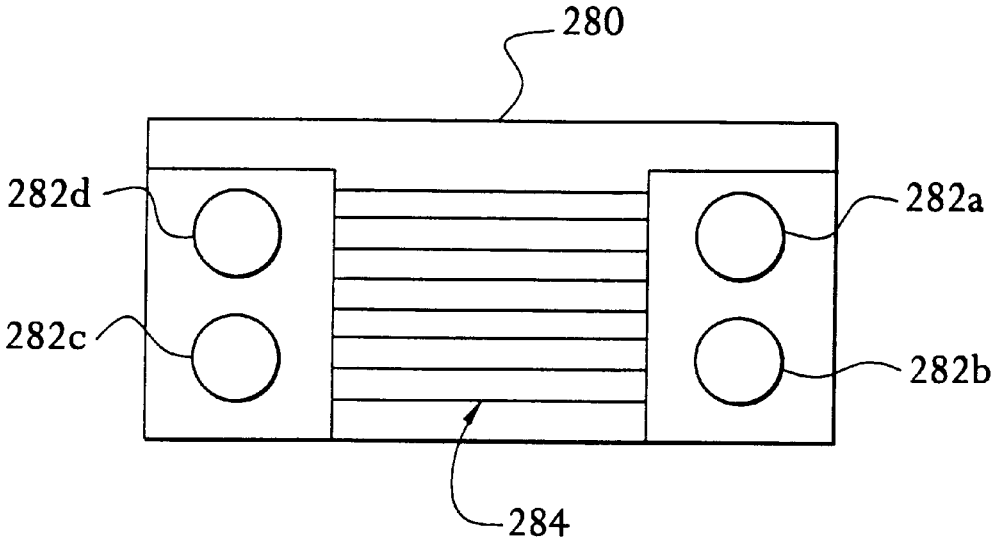
FIG. 28 is an isolated right side elevational view of the keeper of FIG. 19.

In FIGS. 26 and 27 is shown in detail the latch actuating means comprising the actuator 216 and biasing means 218. As best shown in FIG. 27, the torsion spring 218 includes two opposing legs 218*a* and 218*b* and with the leg 218*a* positioned adjacent to the stop 261 of the actuator 216. As discussed earlier, the biasing means 218 while comprising a torsion spring in the present embodiment can comprise any other type of spring member, such as any of the metallic or integral springs disclosed in U.S. Pat. Nos. 3,850,464 and 3,841,674. On assembly of the slam latch 210, the torsion spring 218 is preferably first inserted into the channel 258 within the actuator 216 which defines the latch actuating means of the present embodiment. Thereafter, the latch actuator means is assembled with the latching member 214, which in the present embodiment can be accomplished in one or two ways; in particular, the latching member 214 and latch actuator means being assembled before or after installation in the first panel member 202. For purpose of this illustration, assembly of the components of slam latch 210 will be described after being inserted into the first panel member 202. As illustrated in FIG. 19, the actuator 216 is positioned above the first panel member 202 while the latching member 214 is positioned below the first panel member 202. The body 252 and platform 256 of the actuator 216 is then inserted through the rectangular shaped opening in the first panel member 202 and received into the cavity 222 in the latching member 214. A screw 270 is inserted through the opening 238 in the latching member 214, and into the opening in the bottom surface 254 of the actuator 216, and then tightened for connection of the components and for retaining the slam latch 210 in the aperture through the first panel member 202. As illustrated in FIG. 19, the panel member 202 is positioned between the wall 248 of the actuator 216 and upper surface 220 of the latching member 214, and in this embodiment, preferably the bosses 250*a* and 250*b* on the actuator 216 and bosses 224 and 226 on the latching member 214 are each in engagement with the opposing surfaces of the first panel member 202.

In the present embodiment, the actuator 216 and latching member 214 are each preferably of a resilient plastic material formed by molding or by other manufacturing methods and the torsion spring 218 and screw 270 are each comprised of metal, although it should be understood that any other suitable materials or manufacturing methods can be utilized where desired.

The structure of the keeper 212 and assembly to the second panel member 204 will now be described. As illustrated in the front elevational view of FIG. 19 and isolated right side elevational view of FIG. 28, the keeper 212 includes a body 280 generally rectangular in configuration in this embodiment and means for attachment comprising four substantially annular mounting holes 282*a*–282*d* extending through the body 280. In addition, in this embodiment, the keeper 212 further includes an engaging portion 284 comprising at least one and preferably a plurality of ratcheting teeth or serrations, with each ratcheting tooth or serration comprising a substantially ramped camming surface and a locking surface, preferably corresponding in configuration with the camming and locking surfaces of the engaging portion 242 on the latching member 214. Although not shown, the keeper 212 is secured to the frame 204 via retaining screws or the like received through the openings 282*a*–282*d* and into the surface of the second panel member 204, although it should be understood that any other suitable retaining means can be utilized for the same purpose. The keeper 212 in this embodiment is preferably comprised of resilient plastic material formed by molding, however, any other suitable materials or manufacturing processes can be utilized for this purpose.

The operation of the slam latch 210 for securing the first panel member 202 in a closed position against the second member 204 via engagement with the keeper 212 will now be described. The first and second members 202 and 204 in this embodiment can comprises doors, panels or the like and of any of a variety of different materials, such as wood, metal, or plastic, to name a few. For purposes of this illustration, the first member 202 and second member 204 are a respective door and frame of a cabinet. From an opened position, the door 202 is pivoted in a direction of the frame 204 which results in the angle camming surface 240 of the latching member 214 first engaging a portion of the keeper 212; in particular, as illustrated in FIG. 19, preferably the upper right hand corner of the keeper 212. Thereafter, continued pivotal movement of the door 202 toward its closed position against the frame 204 results with the slam latch 210 being moved rearward, in a direction of arrow 290 against the bias of torsion spring 218, due to the angle of the camming surface 240 riding against the keeper 212. Thereafter, continued closing of door 202 will position the camming surface of the first ratcheting tooth on the latching member 214 in engagement with the ramped camming surface of the first ratcheting tooth of the keeper 212. On additional movement of the door 202 into its closed position against the frame 204, one or more of the ratcheting teeth on the latching member 214 will move along one or more of the ratcheting teeth on the keeper 212. For example, on additional movement of the door 202 to the closed position, the camming surface of the first ratcheting tooth on the latching member 214 will come into engagement with the camming surface of the second ratcheting tooth on the keeper 212, and the camming surface of the second ratcheting tooth on the latching member 214 will come into engagement with the camming surface of the first ratcheting tooth of the keeper 212. This progression of the ratcheting teeth on the latching member 214 along the ratcheting teeth on the keeper 212 will continue until the door 202 is in the closed position against the frame 204, such as shown in FIG. 19. In FIG. 19, each of the ratcheting teeth on the latching member 214 is shown in engagement with each of the ratcheting teeth on the keeper 212, although this is not required and it should be understood that any number of ratcheting teeth on the latching member 214 can be in engagement with any number of ratcheting teeth on the keeper 212.

When the slam latch 210 is in a latched position against the keeper 212 as is illustrated in FIG. 19, the engagement of the ratcheting teeth on the latching member 214 and keeper 212 provide significant holding force to retain the door 202 in its closed and latched position against the frame 204. In the present embodiment, this is accomplished through the engagement of the locking surface of the respective latching member 214 and keeper 212, which are each generally parallel to the surface of the door 202 and frame 204 in this embodiment. In addition, the force exerted by the torsion spring 218 provides additional holding force between the keeper 212 and latching member 214.

For opening of the door 202 out of engagement with the frame 204, the slam latch 210 is moved in a direction of arrow 290 via suitable force exerted on the handle 246, such as by the thumb and finger of an operator, in order to move the ratcheting teeth on the latching member 214 out of engagement with the ratcheting teeth on the keeper 212. The movement of the slam latch 210 in the direction of arrow 290 occurs due to the compression of the torsion spring 218 against the edge of the door 202. The door 202 can then be moved toward its opened position away from the frame 204 when the slam latch 210 is moved sufficiently far enough out of engagement with the keeper 212.

Figure 29:
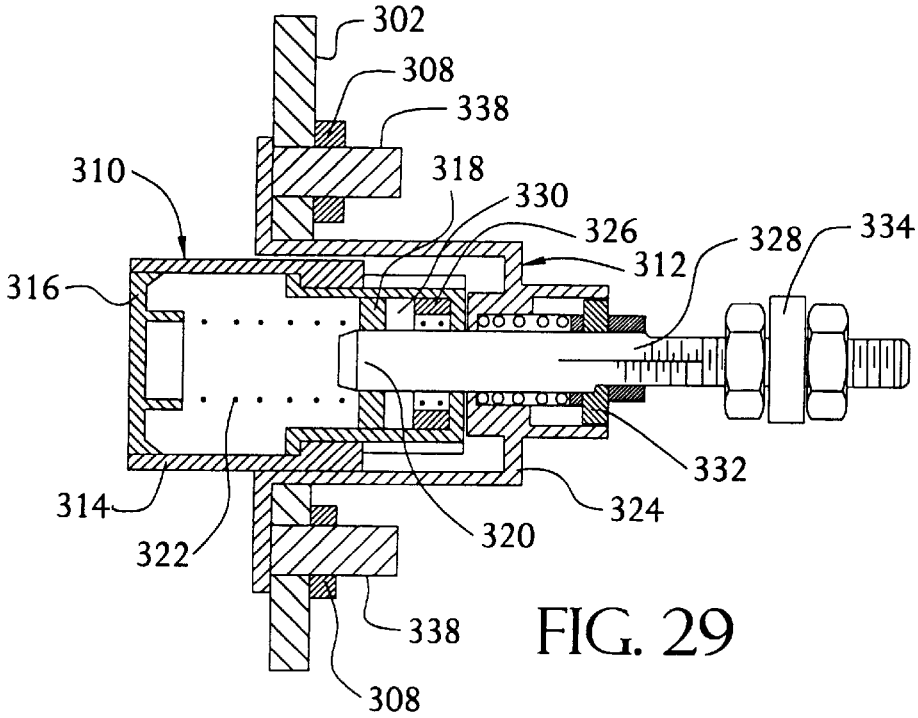
FIG. 29 is a partially sectional elevational view of another actuator in accordance with the present invention illustrated mounted to a latch, and with the latch mounted in a first member and in an unlatched position, the actuator being shown in an extended position.

In FIG. 29 is shown another latch actuating means comprising an actuator 310 mounted in a latch 312, with the latch 312 being shown mounted in a first member 302 and in an unlatched position, and with the actuator 310 being shown in an extended position. Similar to that described earlier, the actuator 310 can also be utilized in connection with a variety of different types of latches. In FIGS. 29–46 is illustrated another type of latch suitable for use with the actuator of the present invention. The latch 312 as illustrated in FIG. 29 is of the type disclosed in U.S. Pat. No. 4,556,244 which is incorporated by reference herein and, for the sake of brevity, only those portions which differ from that disclosed in connection with the '244 patent will be described in detail herein.

The actuator 310 as shown in FIG. 29 includes, as portions thereof, a shell 314, a cap 316, a sleeve or can 318, a spacer 320, a biasing means 322 and a housing 324. In this embodiment, the housing 324 is configured in order to accommodate the actuator 310 as well as the components of the latch 312. The major components of the latch 312 include an annular or ring-like cam 326, an actuating boss comprising a shaft 328, a cam-follower pin 330, a motion-controlled pin 332, and a latching member comprising a pawl 334. The foregoing elements of the actuator 310 will be described in more detail below.

Figure 32:
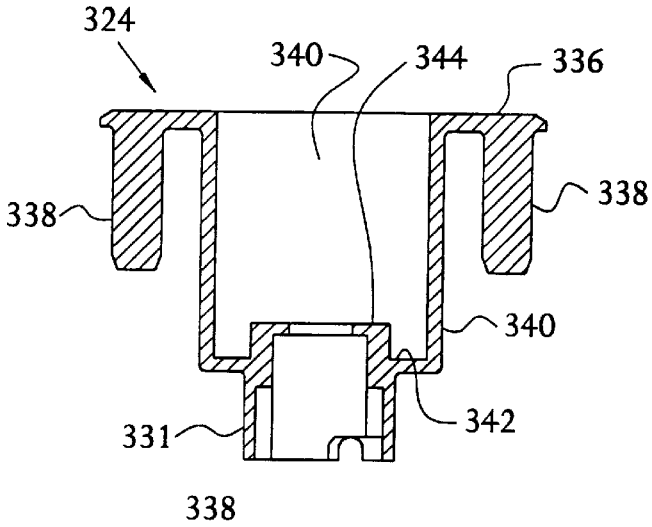
FIG. 32 is an isolated sectional front elevational view of a housing of FIG. 29.
Figure 33:
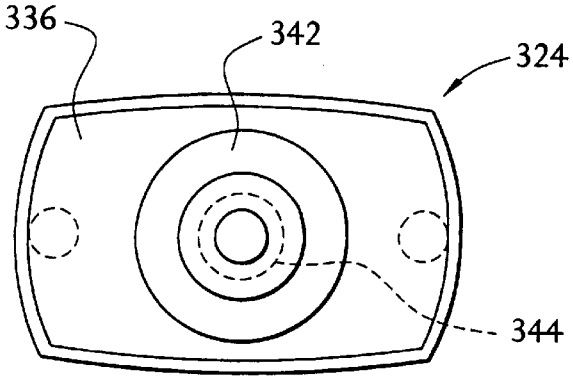
FIG. 33 is an isolated top plan view of the housing of FIG. 32.
Figure 34:
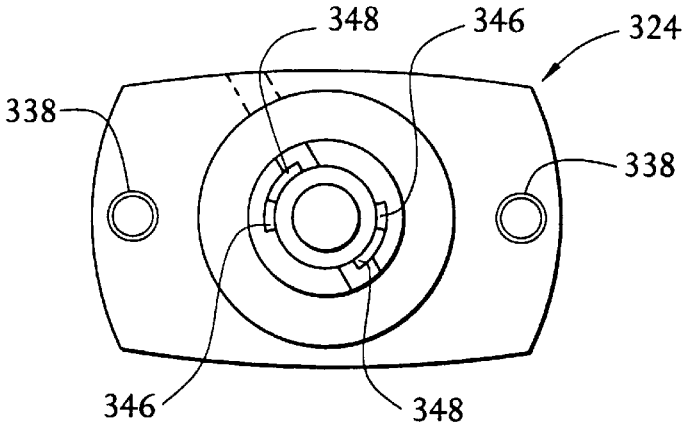
FIG. 34 is an isolated bottom plan view of the housing of FIG. 32.
Figure 35:
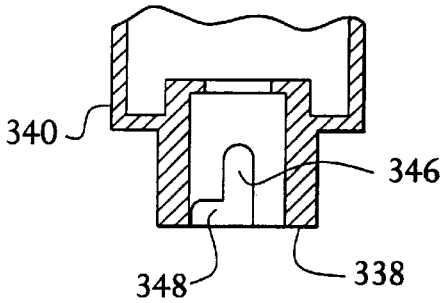
FIG. 35 is a fragmentary sectional view of the housing of FIG. 32.
Figure 36:
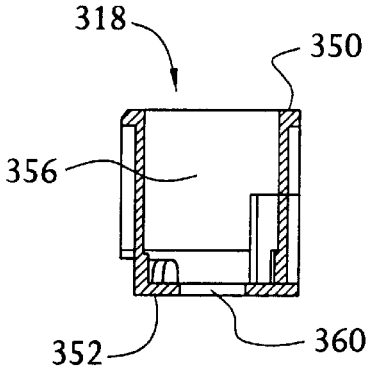
FIG. 36 is an isolated sectional front elevational view of a sleeve of FIG. 29.

The housing 324 is illustrated in detail in the isolated views of FIGS. 32–34. The housing 324 as illustrated in this embodiment includes opposing upper and lower surfaces 336 and 338 and an outer surface 340. The upper surface 336 in this embodiment defines a flange generally rectangular in configuration and includes a pair of mounting lugs 338 each generally cylindrical in cross-section in this embodiment extending from a lower surface of a flange 336. Although not shown, preferably in this embodiment each of the lugs 338 include a threaded portion on its outer surface. In addition, provided within the upper surface 336 in this embodiment is a cavity 340 generally cylindrical in shape and terminating by a substantially annular seating member 342. In addition, a platform 344 also generally annular in shape in this embodiment is positioned against the seating member 342. The platform 344 also includes an opening extending therethrough and generally annular in shape in this embodiment. As best shown in FIG. 32, the housing 324 further includes a sleeve 331 adjacent the platform 344 and terminating by the bottom surface 338. As best shown in FIGS. 32, 34 and 35, the sleeve 331 in this embodiment is generally cylindrical in cross-section and includes at least one and preferably two motion-control channels which, in this embodiment, comprises a pair of axial motion-control slots 346, 180° apart, and a pair of laterally extending motion-control recesses 348, spaced 180° apart. The sleeve 331 in this embodiment includes an opening therethrough generally cylindrical in shape and attached with the opening extending through the platform 344. In operation, the motion-control slots 346 and recesses 348 receive in sequence, in one order or the other, the motion-control pin 332, which is described in detail in the '244 patent.

Figure 37:
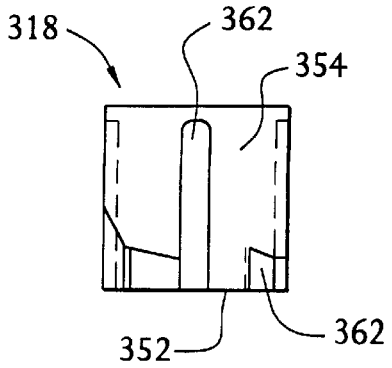
FIG. 37 is a right side elevational view of the sleeve of FIG. 36.
Figure 38:
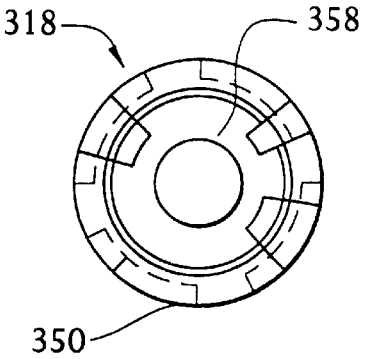
FIG. 38 is a top plan view of the sleeve of FIG. 36.
Figure 39:
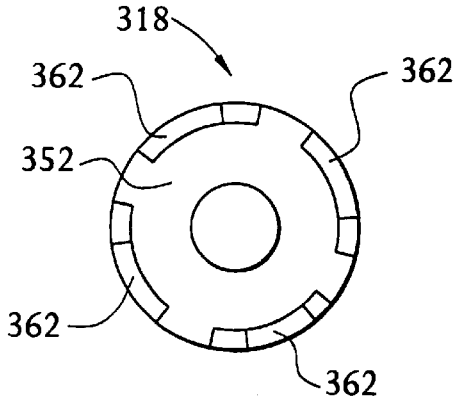
FIG. 39 is a bottom plan view of the sleeve of FIG. 36.

The sleeve 318 is illustrated in the isolated views of FIGS. 36–39. In this embodiment, the sleeve 318 is generally cylindrical in cross-section and includes opposing top and bottom surfaces 350 and 352 and an outer surface 354. The top surface 350 in this embodiment includes an opening 356 extending therein generally cylindrical in shape and terminating by the substantially annular seating member 358. The bottom surface 352 in this embodiment includes an opening 360 extending therein generally annular in shape and extending through the seating member 358 to the opening 356. As best shown in FIG. 37, the sleeve 318 in this embodiment further includes at least one and preferably four guiding channels 362 therethrough generally J-shaped in this embodiment, although other configurations can also be used for this purpose.

Figure 40:
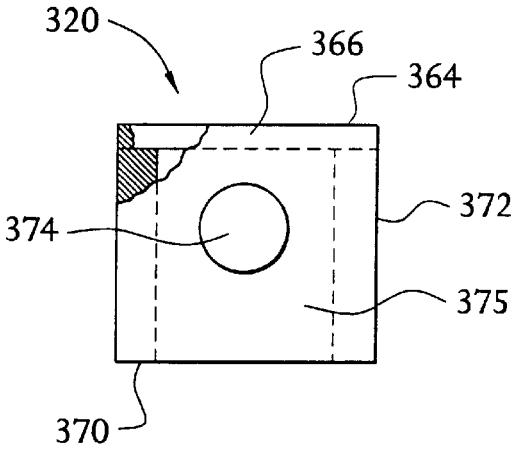
FIG. 40 is an isolated front elevational view partly in section of a spacer of FIG. 29.
Figure 41:
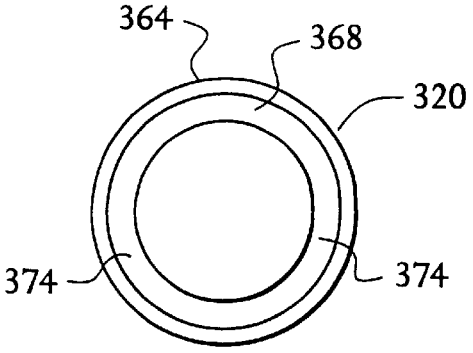
FIG. 41 is a top plan view of the spacer of FIG. 40.

The spacer 320 is illustrated in the isolated views of FIGS. 40 and 41. In this embodiment, the spacer 320 is generally cylindrical in shape defined by an upper surface 364, a cavity 366 extending within the upper surface 364 and terminating by an annular seating member 368 and a second aperture extending from the annular seating member 368 to a bottom surface 370 generally cylindrical in this embodiment. The spacer 320 in this embodiment also includes an outer surface 372 having a pair of aligned apertures 374 generally circular in shape extending through opposite sides of the outer surface 372.

Figure 42:
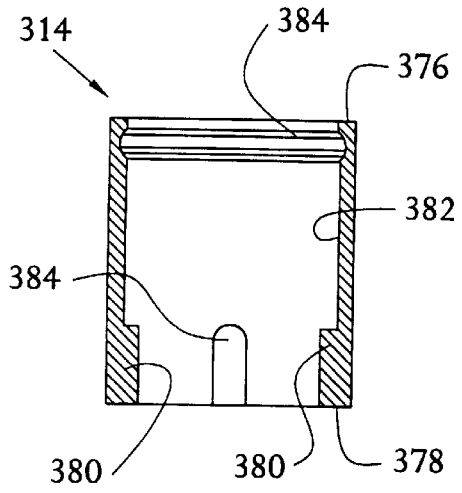
FIG. 42 is an isolated sectional front elevational view of a shell of FIG. 29.
Figure 43:
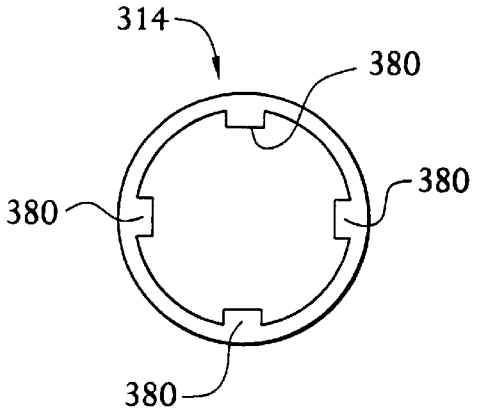
FIG. 43 is a bottom plan view of the shell of FIG. 42.
Figure 44:
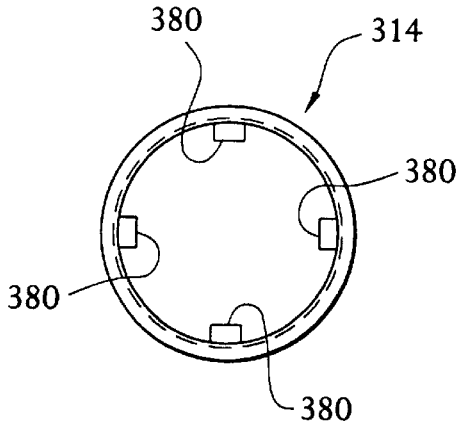
FIG. 44 is a top plan view of the shell of FIG. 42.

The shell 314 is illustrated in the isolated views of FIGS. 42–44. The shell 314 in this embodiment is generally cylindrical in configuration defining opposing upper and lower surfaces 376 and 378 and with an opening extending longitudinally through the sleeve 318 extending through the surfaces 376 and 378. The sleeve 314 of this embodiment further includes at least one and preferably four retainers 380, each generally rectangular in configuration in this embodiment, extending from the inner surface 382 of the shell 314 defined by the opening extending therethrough and positioned proximate the lower surface 378 and at generally 45° intervals in this embodiment. The shell 314 in this embodiment also includes within its inner surface 382 a substantially annular channel 384 proximate the upper surface 376. In addition, in this embodiment, the shell 314 may also include a notch 384 within the inner surface 382 and positioned proximate the lower surface 378.

Figure 31:
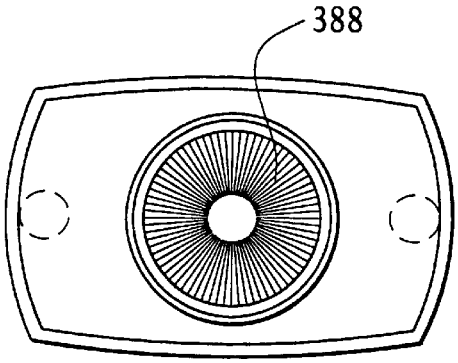
FIG. 31 is a top plan view of the actuator and latch of FIG. 30.
Figure 46:
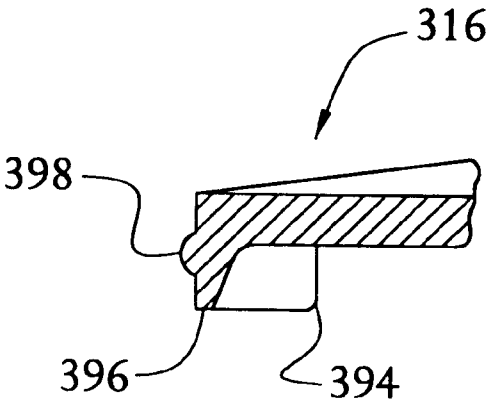
FIG. 46 is a fragmentary front elevational view in section of the cap of FIG. 45.
Figure 45:
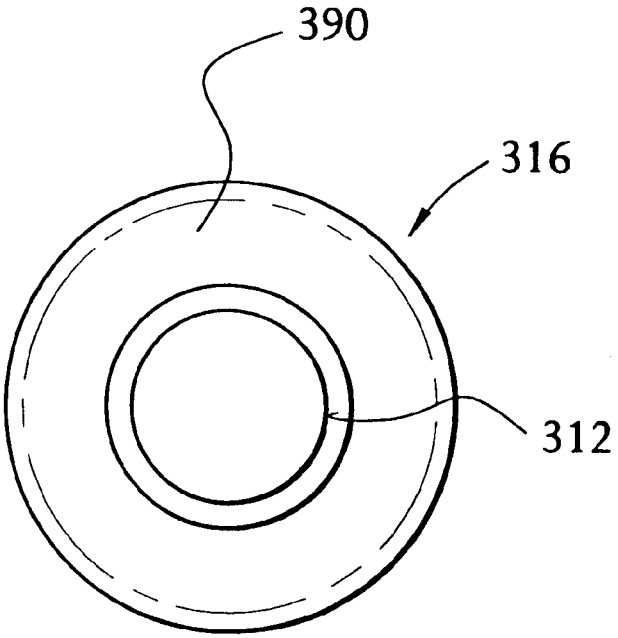
FIG. 45 is an isolated bottom plan view of a cap of FIG. 29.

The cap 316 in this embodiment is best illustrated in the top plan view of FIG. 31 and isolated views of FIGS. 45 and 46. The cap 316 in this embodiment includes an upper surface 388 generally ribbed in this embodiment and a lower surface 390. In addition, in this embodiment, extending from the lower surface 390 is a substantially annular and hollow projection 392. In addition, as best illustrated in the fragmentary sectional view of FIG. 318, the cap 316 in this embodiment further includes a connecting member 396 generally annular in this embodiment extending from the bottom surface 394 and positioned at the perimeter of the cap 316. The connecting member 396 in this embodiment defines a boss 398 extending from the connecting member 396 and outwardly away from the cap 316.

Assembly of the actuator 310 with the latch 312 will now be described. Preferably, the cam 320 is inserted into the opening 356 within the sleeve 318. The shaft 328 is then inserted into the opening 375 extending within the spacer 320 and the cam-follower pin 330 is inserted through both the opening 374 in the spacer 320 and an opening extending through the shaft 328. The terminating end of the shaft 328 opposite its connection with the spacer 320 is inserted into the openings 356 and 360 through the sleeve 318. The sleeve 318 is then inserted into the opening through the shell 314 and with the retainers 380 positioned within the channels 362 of the sleeve 318, with this partial assembly then being inserted into the housing 324 by the free end of the shaft 328 being inserted into and through the openings within the platform 344 and sleeve 331. At this point, preferably the remaining components of the latch 312 are assembled in the manner described in the '244 patent. Thereafter, preferably the biasing means 322 which is of the coil spring type in this embodiment is positioned on the end of the shaft 328 at one end and into the hollow opening of the projection 392 at its other end, with the cap 316 then inserted into the channel 384 within the inner surface 382 of the shell 314 for connection.

The various components of the actuator 310 can be comprised of any suitable materials and from any suitable manufacturing processes. In the present embodiment, the housing 324, sleeve 318, shaft 328, cam 320, pins 330 and 332 and biasing means 322 are comprised of metal or metal-like materials and the shell 314, cap 316 and spacer 320 are preferably manufactured of conventional thermoplastic or thermosetting materials, such as by injection molding.

Figure 30:
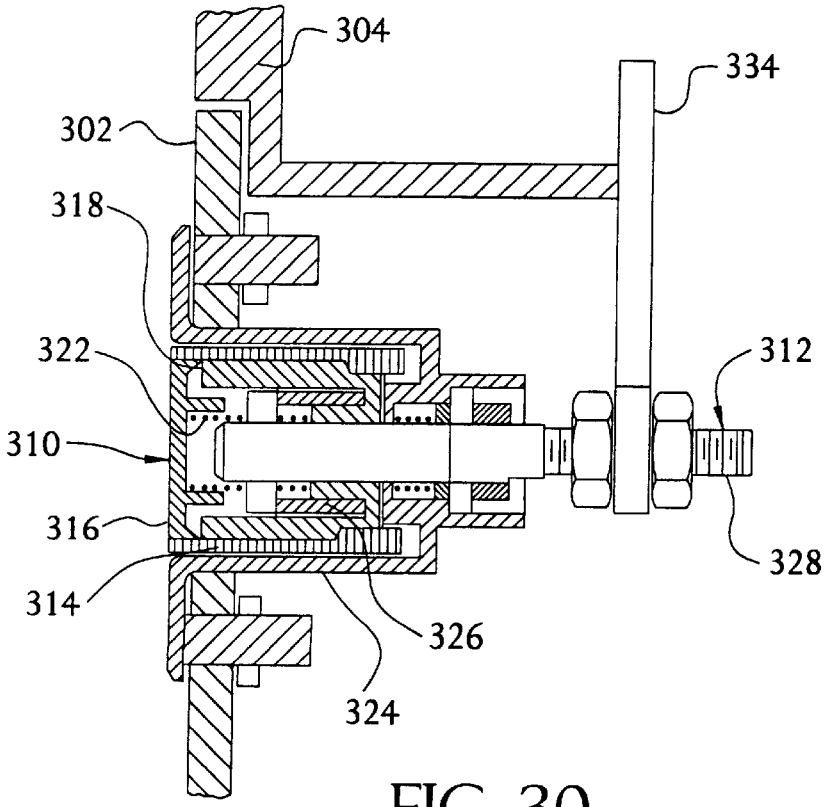
FIG. 30 is a partially sectional elevational view of the actuator shown mounted to a latch of FIG. 29 and with the latch shown in a latched position engaging a second member, the actuator being shown in a retracted position.

The operation of the actuator 310 in connection with the latch 312 will now be described with reference to FIGS. 29 and 30. Latch 312 is illustrated in FIG. 29 mounted in a first member 302 and is shown in an unlatched position and in FIG. 30 shown in a latched position against a second member 304. The first and second members 302 and 304 can comprise any of a variety of types of closure members, such as doors, panels and the like. As described in more detail in the '244 patent, the pawl 332 undergoes successive rotation and axial movements as the latch 312 is moved between its latched and unlatched positions. In this embodiment, the operation of the latch is controlled through rotation of the actuator 310. In the present embodiment, rotation of the pawl 332 between its latched and unlatched positions is possible when the actuator 310 is either in an extended position as is shown in FIG. 29 or in a retracted position as is shown in FIG. 30. The advantage of the actuator 310 of the present embodiment is that it can be moved into its extended position for ease of use and then, after the pawl 334 is moved to its desired position, the actuator 310 then moved to its retracted position. For purpose of this illustration, it will be assumed that the actuator 310 is in its retracted position and the pawl 332 is in its latched position such as shown in FIG. 30. In this embodiment, in order to move the actuator 310 towards its extended position, a suitable amount of depression force is exerted on the outer surface 388 of the cap 316, such as by the thumb against the rib surface of the cap 316. The force exerted on the cap 316 works to move the shell 314 slightly in an inward direction toward the pawl 334 against the force of the biasing means 322, so that the retainers 380 will move within the channels 362 of the substantially stationery sleeve 318. Thereafter, a suitable rotational movement of the cap 316 will impart rotational movement of the retainers 380 within the J shaped channels 362, with the force of the biasing spring 322 then urging the actuator 310 toward its extended position shown in FIG. 29. In operation, preferably the depression and rotational movements on the cap 320 occurs at substantially the same time. In this embodiment, the amount of extension of the actuator 310 is regulated by the interrelationship between the retainers 380 within the J shaped channels 362 of the sleeve 318.

Additional embodiments of the present invention are illustrated in FIGS. 47–52. For the sake of brevity, the embodiments of the present invention illustrated in FIGS. 47–52 will be described with reference to the earlier embodiments of the present invention.

Figure 47:
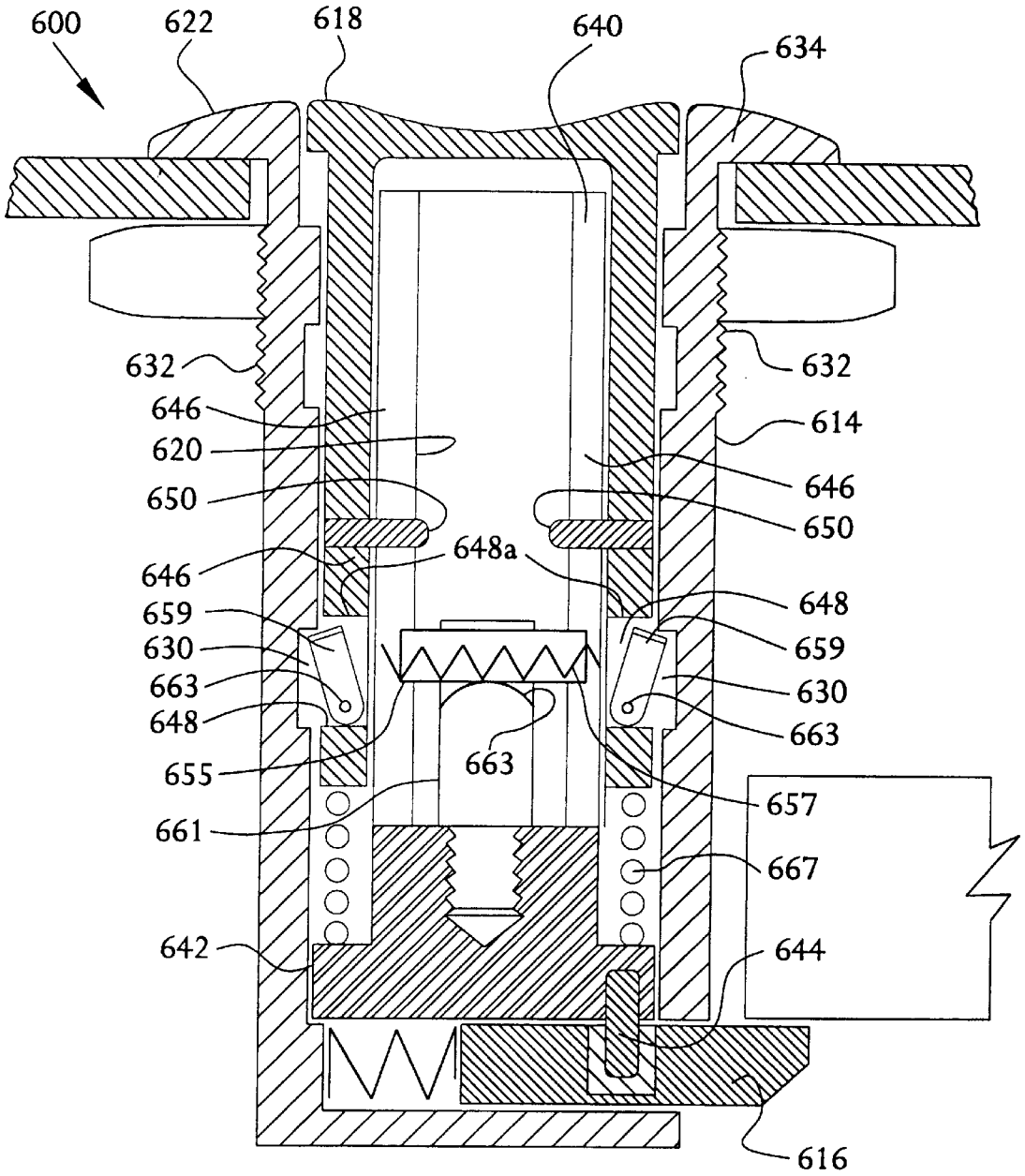
FIG. 47 is a sectional front elevational view of a latch in accordance with another embodiment of the present invention shown mounted in a first member.

In FIG. 47 is shown a latch of the slam latch type and which includes another latch actuating means in accordance with the present invention. In this embodiment, the latch 600 includes a housing 614, a cam or sleeve 620, a handle 618 and pawl 616, details of which will be described below.

The housing 614 in its embodiment includes a pair of opposing cavities 630 and 632, each generally rectangular in configuration, provided within the inner surface. The cavities 630 and 632 can also be formed as a continuous channel extending entirely around the inner surface of the housing 614. In addition, in this embodiment the housing 614 also includes a substantially annular depression 634 extending within the upper surface 622.

The cam or sleeve 620 in its embodiment defines a generally tubular member 640 attached with a body 642, which in this embodiment is mushroom shaped in configuration. In addition, in this embodiment a drive member 644 comprises a pin received within an opening within the bottom surface of the body 642, though as should be understood an integral drive member 644 can also be provided similar to that illustrated in the slam latch 10. In addition, in this embodiment the sleeve 620 includes at least one and preferably a plurality of slots extending at predetermined distances along it longitudinal axis, which in the present embodiment comprises two slots 646, the purpose for which will be described in more detail below.

The handle 618 in this embodiment includes proximate its lower end at least one and preferably two opposing cavities 648, each generally rectangular in configuration. In addition, in this embodiment the handle 618 includes a pair of opposing slots into which pins 650, each generally cylindrical in configuration are received, although as should be understood the pins 650 can be provided integrally connected to the handle 618.

Figure 48:
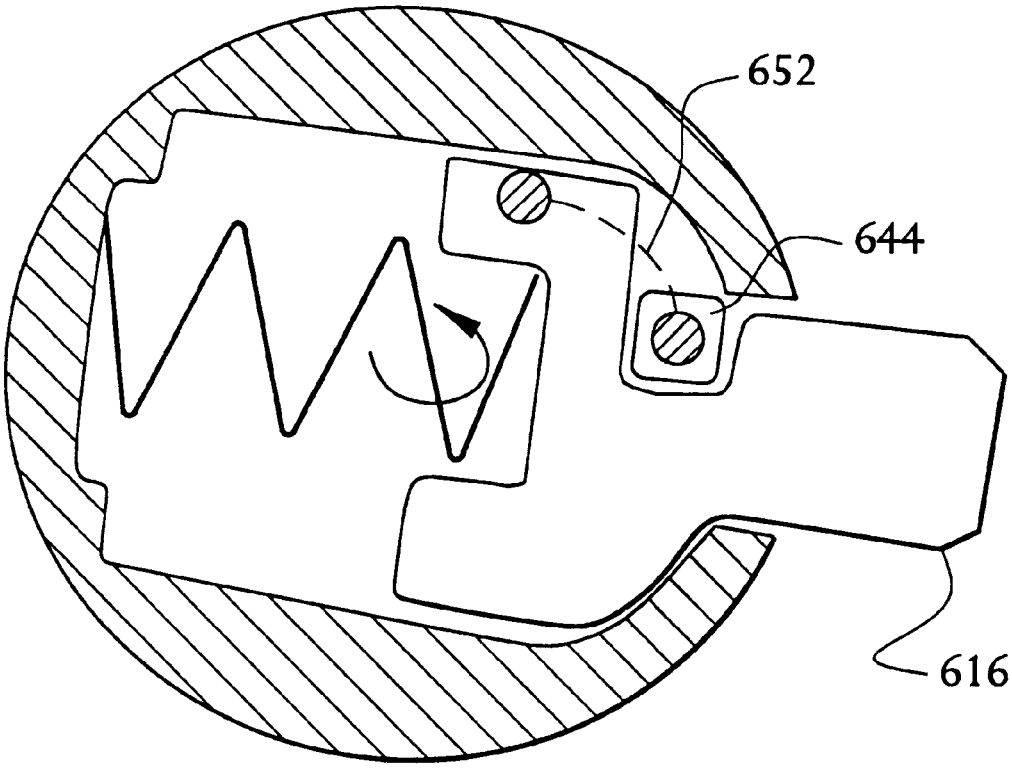
FIG. 48 is a bottom plan view of the latch of FIG. 47 illustrating operation of the latch for retraction of the pawl.

The configuration of pawl 616 is best illustrated in the bottom plan view of FIG. 48. Pawl 616 is generally T-shaped in configuration and includes in this embodiment a notch or slide 652 generally rectangular in configuration within its outer surface, the purpose for which will be described below.

In this embodiment, means are provided for retaining the handle 618 in its closed position including a biasing means comprising in this embodiment a compression spring 657 and at least one and preferable two detent members comprising tabs 659, attached to opposing ends of the compression spring 657, such as by a screw, rivet or the like. In addition, a generally flexible sleeve can be provided into which the compression spring 657 is received such as the hose 655 illustrated in FIG. 47. In this embodiment, each of the tabs 659 preferably are generally elongated in configuration having a substantially planar upper end and a generally radiused lower end. In addition, in this embodiment, a bearing member comprising a generally elongated bolt 661 is secured to the body 642 of the cam 620, such as by a screw connection in the present embodiment. In addition, in the present embodiment preferably the bolt 661 includes at its upper end a depression defining by a substantially radiused wall 663.

The assembly of the latch 600 will now be described. Pin 650 extending from the handle 618 is positioned within the slots 646 within the cam 620. The pin 644 extending from the portion 642 of the cam 620 extends within the slide 652 within the pawl 616. The hose 655 which protects the spring 657 is positioned in the depression within the bolt 661 and preferably engaging the substantially radiused wall 663. The opposing ends of the hose 655 are preferably received within the opposing slots 646 within the cam 620. The tabs 659 are positioned within the cavity 648 of the handle 618. FIG. 47 illustrates a position of the tabs 659 when the handle 618 is retracted in its closed position, with the substantial planar upper surfaces in engagement with a corner portion of the cavity 630 within the housing 614.

The operation of the latch 600 in order to pop-out the handle 618 to its extended position will now be described. Similar to the latch 10, the handle 618 is depressed in order to be moved to its extended position. In this embodiment, as the handle 618 is depressed, the surface 663 defined by the bolt 661 comes into engagement with the hose 655 and spring 657 causing each tab 659 to pivot away from the housing 614. In the present embodiment, preferably each of the tabs 659 are pivotally attached proximate the substantially radiused end to the handle 618, such as by a pin 653, in order to accommodate the pivoting movements of the tabs 659. As the tabs 659 are moved away from the corner portion of the cavity 630 in housing 614, the handle 618 is urged to its retracted open position by the bias of the compression spring 667. The extent of movement of the handle 618 towards it open position is regulated by the position of the cavities 632, into which the tabs extend in order to retain the open position of the handle 618. Similarly, as the handle 618 is moved back towards it retracted position from its extended position, the tabs 659 are moved out of the cavities 632 by pivoting about the pin 653 until the tabs 659 are again positioned adjacent the cavities 630. In this embodiment, the flexibility of the hose 655 operates to provide further retraction of the tabs 659 from the housing 614 as the handle is popped-out from its retracted position. In particular, as the handle 618 is depressed from the position shown in FIG. 47, the hose 655 is slightly flexed and compressed within the substantially curved upper wall 663 of the bolt 661, which provides for improved flexing of the spring 657 and accordingly retraction of the tabs 659.

The operation of the latch 600 for retraction of the pawl 616 will now be described. In this embodiment, rotation of the handle 618 when in its extended position results with corresponding rotation of the cam 620 due to the engagement of the pin 650. The rotational movement of the handle 618 is translated to the pin 644 positioned within the slide 652 with the pawl 616. The movement of the pin 634 engages the back wall of the slide 652 which forces the pawl 616 towards its retracted position. The travel of the pin 644 as the pawl 616 is moved toward its retracted position as illustrated in dotted lines.

The components of the latch 600 can be comprised of any suitable materials and from any sufficient manufacturing process, such as formed metal and/or molded plastic.

Figure 49A:
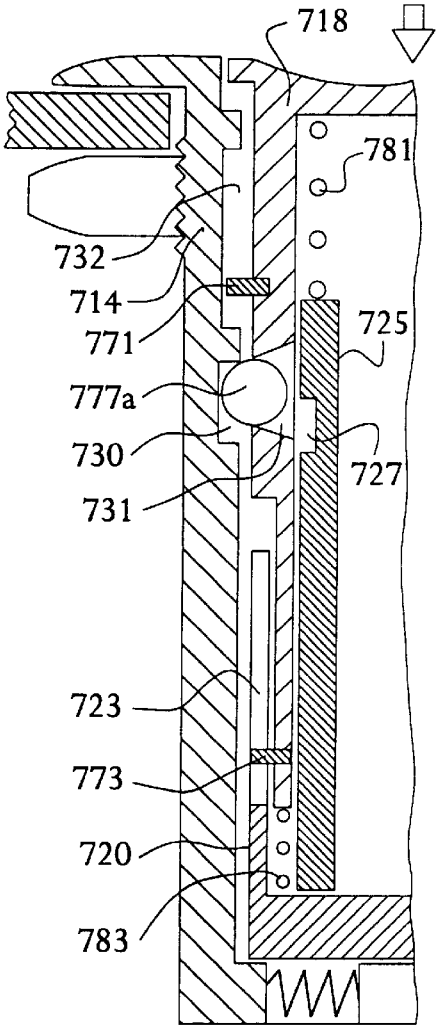
FIGS. 49*a*–49*c* is a fragmentary section front elevational views of a latch in accordance with another embodiment of the present invention.
Figure 49B:
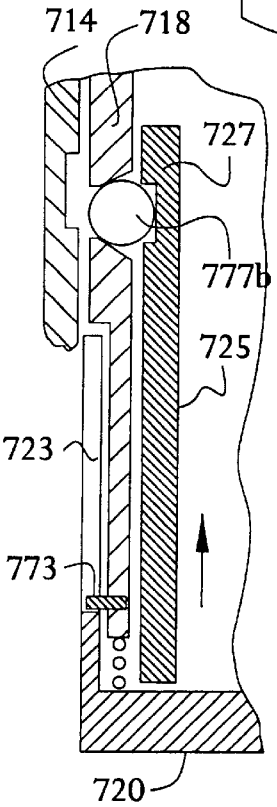
Figure 49C:
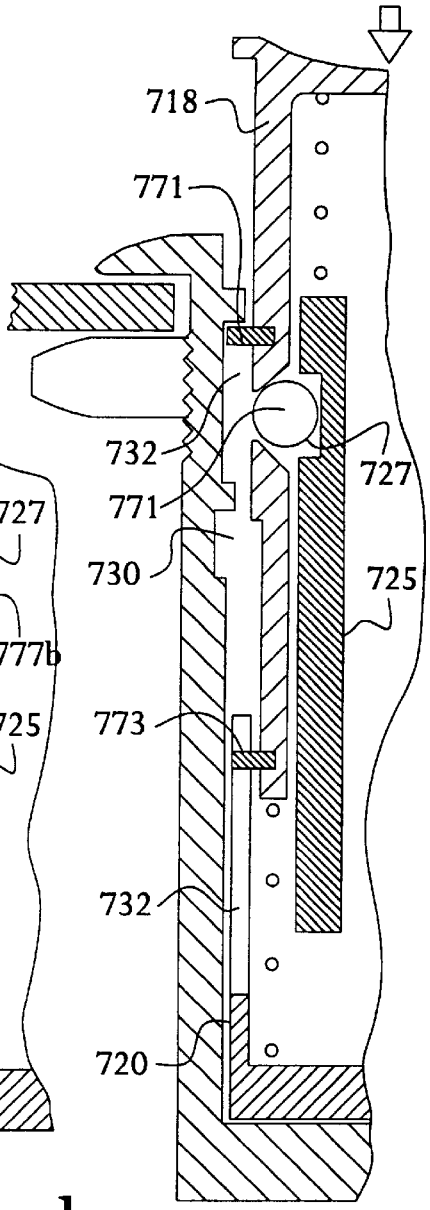

A latch in accordance with another embodiment of the present invention is illustrated in FIGS. 49*a–c*. The latch 700 as illustrated in FIGS. 49*a–c* is similar to the latch 600 described above. The housing 714 includes at least one and in this embodiment a pair of cavities 730 and 732 within the inner surface of the housing 714 similar to the cavities 630 and 632. In the present embodiment, only one of the cavities 730 and 732 is shown and, as described above, the opposing cavities can be provided as a single channel extending around the entire inner surface of the housing 714. In the present embodiment, preferably the cavity 732 comprises a slot along the longitudinal axis of the sleeve 720 and which is smaller in diameter than the cavity 730.

The handle 718 in this embodiment includes at least one and preferably at least two apertures 731 extending therein (only one of which is visible). In the present embodiment, the apertures 731 are preferably conical in shape and positioned so as to taper inwardly in a direction of the outer surface of handle 718.

The latch 700 also includes in this embodiment a sleeve or can 720 defining a generally cup-shaped member and at least one and preferably a pair of opposing cavities defining slots 723 (only one of which is visible) extending along its longitudinal axis. In addition, in this embodiment the latch 700 includes a generally elongated tubular member 725 inside of said handle 718 and can 720. In the present embodiment, the member 725 includes at least one and preferably a pair of opposing cavities 727 (only one of which is visible) within the outer surface thereof. Similar to the cavity 730 and 732, the cavity 727 can also be provided as an annular cavity surrounding the tubular member 725.

The assembly and operation of the latch 700 will now be described. In this embodiment, pins 771 and 773 are provided extending from the handle 718. As described earlier, the pins 771 and 773 can be provided as separate members received within the handle 718 or provided as one-piece extending out from the handle 718. In the present embodiment, the pins 771 and 773 are received into the cavities 732 and 723 provided within the housing 714 and sleeve 720, respectively. In addition, a bearing member, such as a spherical ball or roller bearing cylinder, is provided within the opening 731 within the handle 718. In a preferred embodiment, a plurality of bearing members are provided and can be positioned at defined intervals, for example, three bearing members at 120° intervals. In operation, when the latch 700 is positioned with the handle 718 in its retracted closed position shown in FIG. 49*a*, the bearing member is positioned within the cavity 730 of the housing 714, as is shown by the bearing member 777*a*. The interaction between the bearing member 777*a* and the surface defined by the cavity 730 retains the handle 718 in its closed position. In order to pop-out the handle 718, the handle 718 is depressed which moves the bearing member 777*a* in a downward direction so as to be positioned substantially adjacent to the cavity 727 within the tubular member 725 as shown in FIG. 49*b*. The configuration of the opening 731 allows the bearing member 777*a* to roll down the sloped surface of the opening 731 and into the cavity 727 as shown by the bearing member 777*b*. Thereafter, the handle 718 and tubular portion 725 are moved to an extended position shown in FIG. 49*c* due to the bias of a spring mechanism, such as a compression spring 781 positioned between the handle 718 and tubular member 725 and a compression spring 783 between the handle 718 the can 720. In the present embodiment, the motion of the handle 718 toward its extended position is regulated by the movement of the pins 771 and 773 within the respective cavities 732 and 723. Similarly, as the handle 718 is moved from its extended position back toward its retracted position, the bearing members 777 move out of the cavity 727 within the portion 725 and back into the cavity 730 within the housing 714. The remaining components and operation of the present embodiment are similar to the latch 600.

Figure 50:
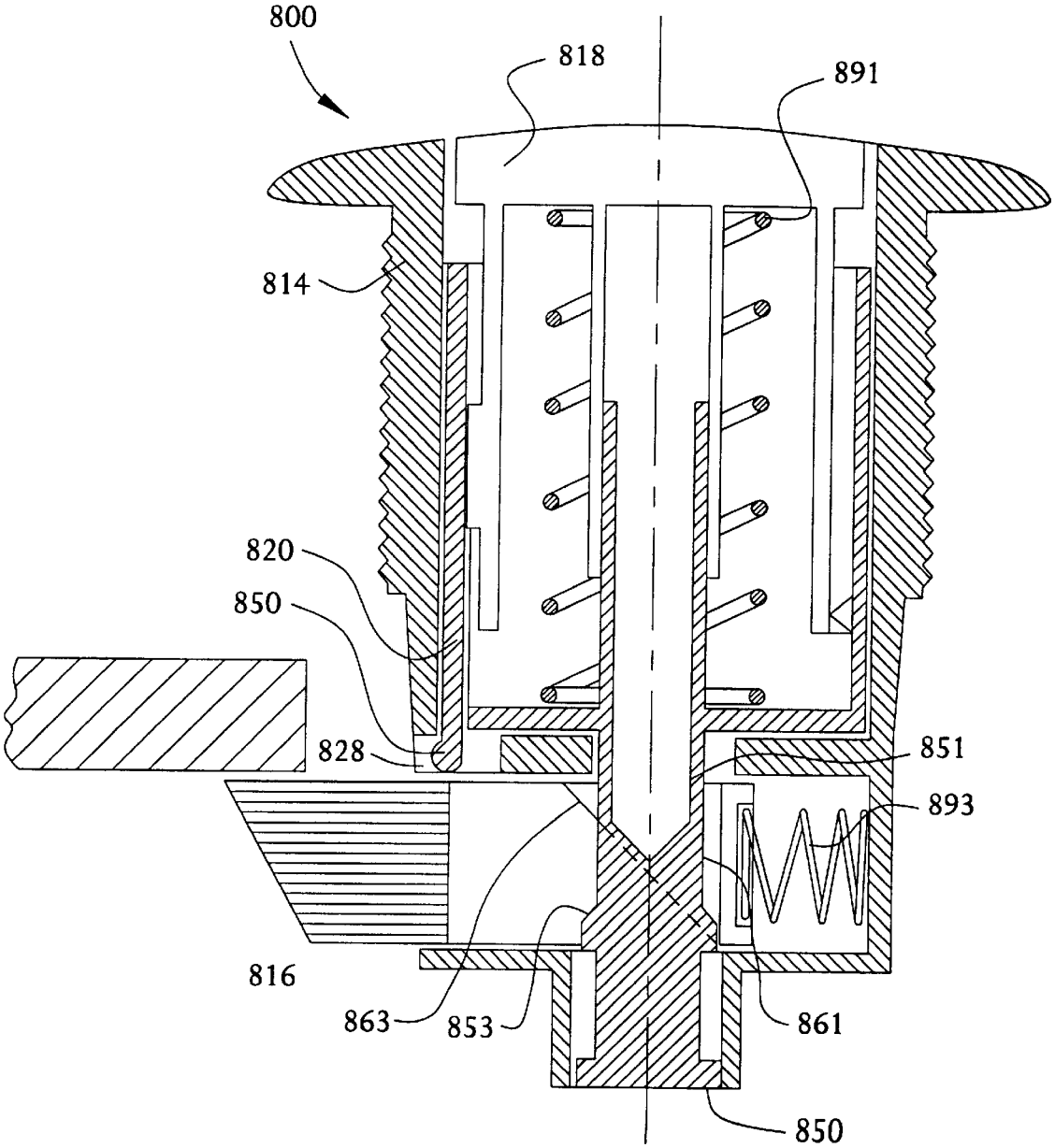
FIG. 50 is a sectional front elevational view of a latch in accordance with another embodiment of the present invention.
Figure 50A:
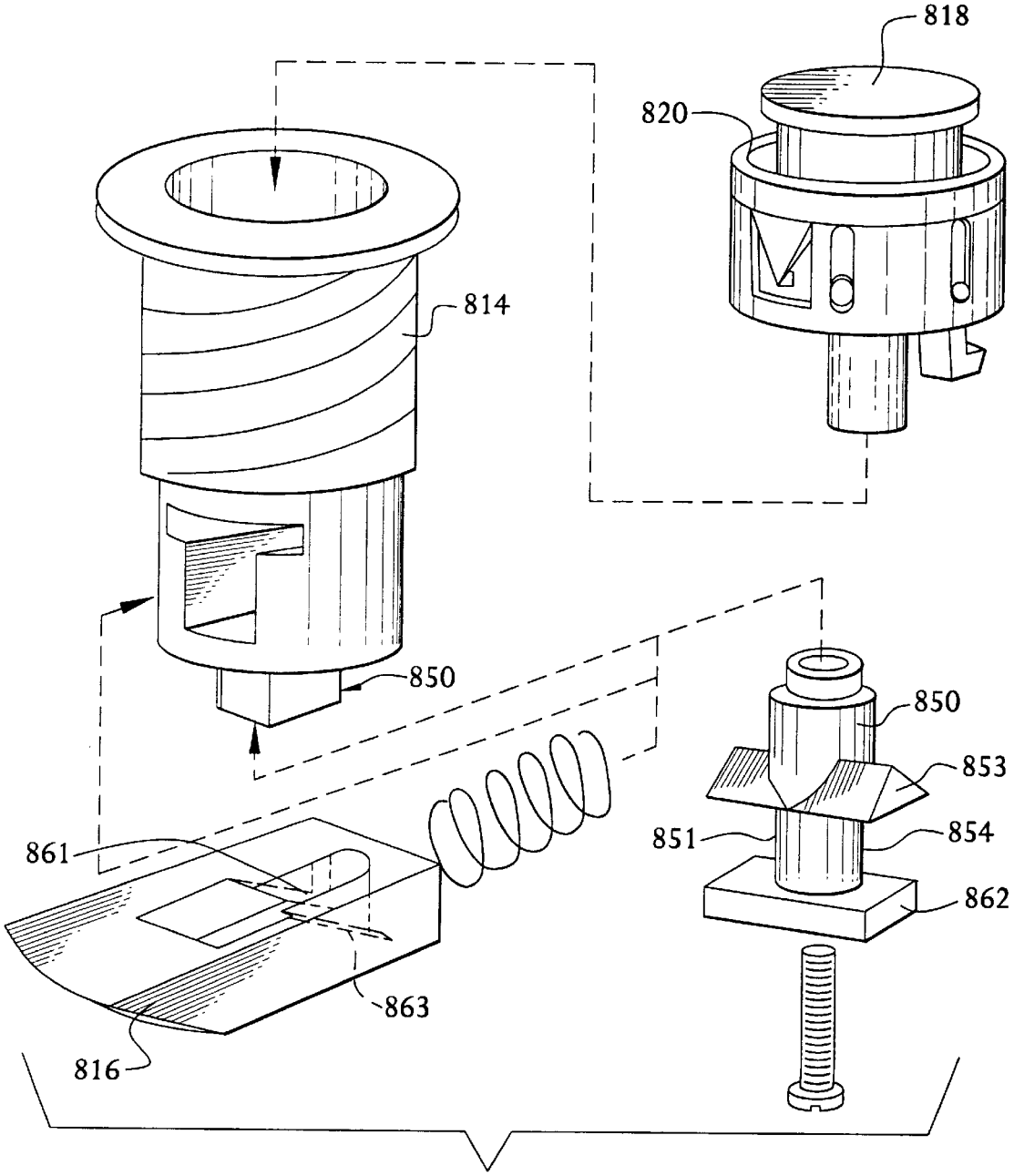
FIG. 50*a* is an exploded perspective view of the latch of FIG. 50.
Figure 50C:
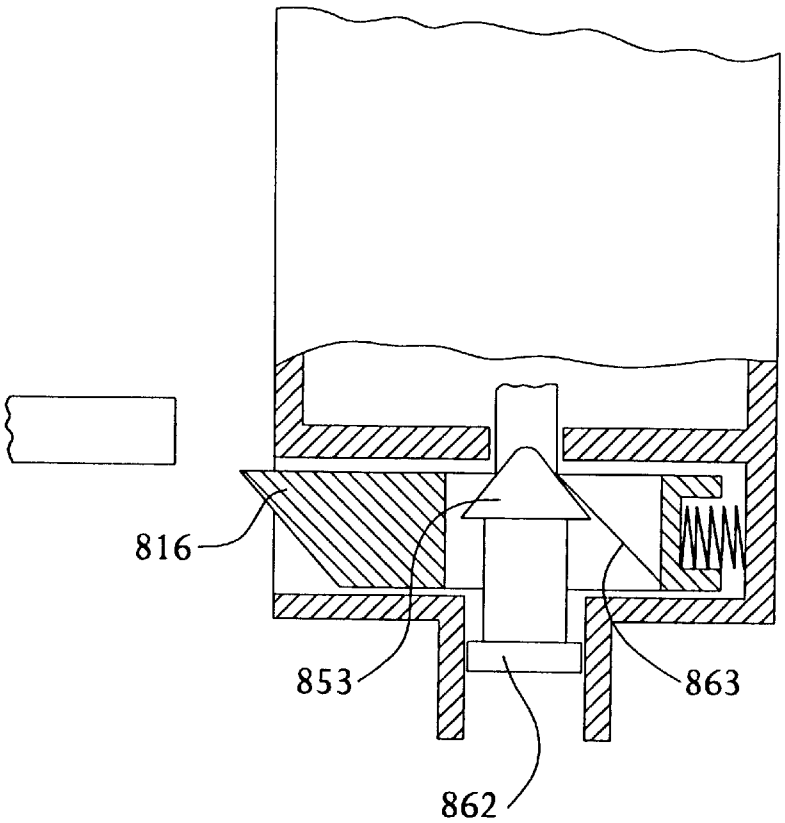
FIGS. 50*b*–*c* are fragmentary sectional views of the latch of FIG. 50 showing an extended and a retracted position of a pawl.
Figure 50B:
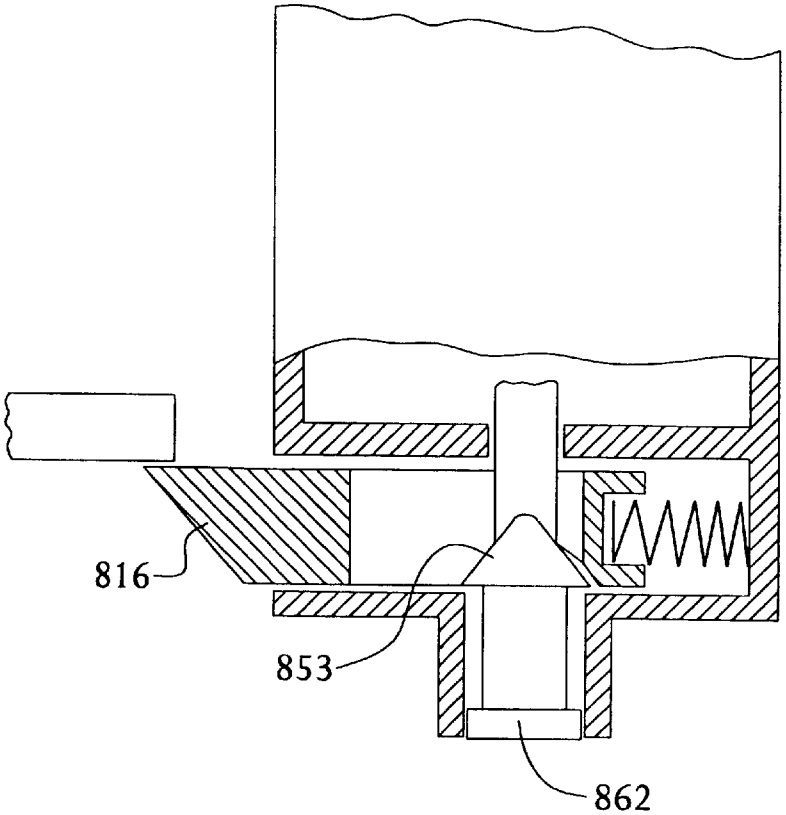

Another embodiment of the latch of the present invention is illustrated in FIGS. 50*c* and 50*a–c*. The latch 800 shown in FIG. 50 is again of the slam-action type including a housing 814 a handle 818, a sleeve or cam 820 and a pawl 816. In this embodiment, the handle 818 and housing 814 are similar to that shown with respect to the latch 10. The can 820 in this embodiment differs from the can 20 in that the boss 850 is adapted to operate as a detent rather than to keep the can in a mounted position, such as the boss 50 of the can 20. The details of which will be described in more detail below. In addition, in the present embodiment, the drive means comprises a single drive member 850 defining in this embodiment a generally cylindrical extension 851, a projection 853 comprising a cam surface generally triangular in cross-section in this embodiment and an actuator 862 attached at a distal end of said extension 851 comprising a generally planar wall in the present embodiment, as best illustrated in FIG. 50*a*. In addition, in this embodiment, the extension 851 is comprised of two parts attached together by a screw extending through an opening in the second part and secured within a threaded aperture in the first part, although in other embodiments the extension 851 can also be provided comprised of greater or fewer parts, such as a single part.

The pawl 816 in the present embodiment includes an aperture 861 extending therethrough between upper and lower portions and a ramped cam surface 863 adjacent to the aperture 861 defined by a cavity provided within the bottom of the pawl 816.

Assembly and operation of the latch 800 will now be described. The handle 818 and can 820 are attached in a similar manner as handle 18 and can 20 of the latch 10 and which includes a compression spring 891 positioned therebetween. When the handle 818 is in its retracted closed position shown in FIG. 50*a*, the detent 850 of the can 820 is received within the opening 828 within the housing 814 in order to retain the can 820 in position. The drive member 850 in this embodiment extends through the aperture 861 within the pawl 816 and extends into an opening provided in the bottom of the housing 814, which is generally cylindrical in shape in the present embodiment. In this embodiment, the drive member 850 is assembled by one part of extension 851 inserted up through the aperture 861 of the pawl 816 for connection to the first part by the retaining screw.

The operation of the latch 800 will now be described. From the latched position shown in FIG. 50, the handle 818 is first depressed which provides pop-out of the handle 818 similar to the handle 18. Thereafter, for retraction of pawl 816, the handle 818 is then pulled outward away from the housing 814, which forces the detent 850 of the can 820 out of the opening 828 of the housing 814. Thereafter, continued pulling of the handle 818 forces the pawl 816 towards its retracted position against the bias of the compression spring 893 due to the engagement of the cam surface of portion 853 with the cam surface 863 of the pawl 816, as shown in FIG. 50*c*. In this manner, the pawl 816 is retracted to a position so as to be moved away from the keeper, and with continued pulling of the handle 818 opening the panel member into which the latch 800 is mounted. When the handle 818 is released by the user, the force of the compression spring 893 operates to bias the pawl 816 to its extended position and correspondingly move the can 820 in an inward direction toward the pawl 816, due to the engagement between the cam surface of portion 853 and the cam surface 863 of the pawl 816, as is shown in FIG. 50*b*. In this manner, the pawl 816 is then moved back toward its extended position. Thereafter, movement of the handle 818 to its retracted position will occur in the same manner as that with respect to the handle 18 and can 20 of the latch 10. In this embodiment, supplemental means for retracting of the pawl 816 is also provided by the actuator 862; in particular, depression on said actuator 862 will retract the pawl 816 independent of the handle 818. Although not shown, in another embodiment an additional spring can be provided for moving the can 820 to the closed position when handle 818 is released.

Figure 51:
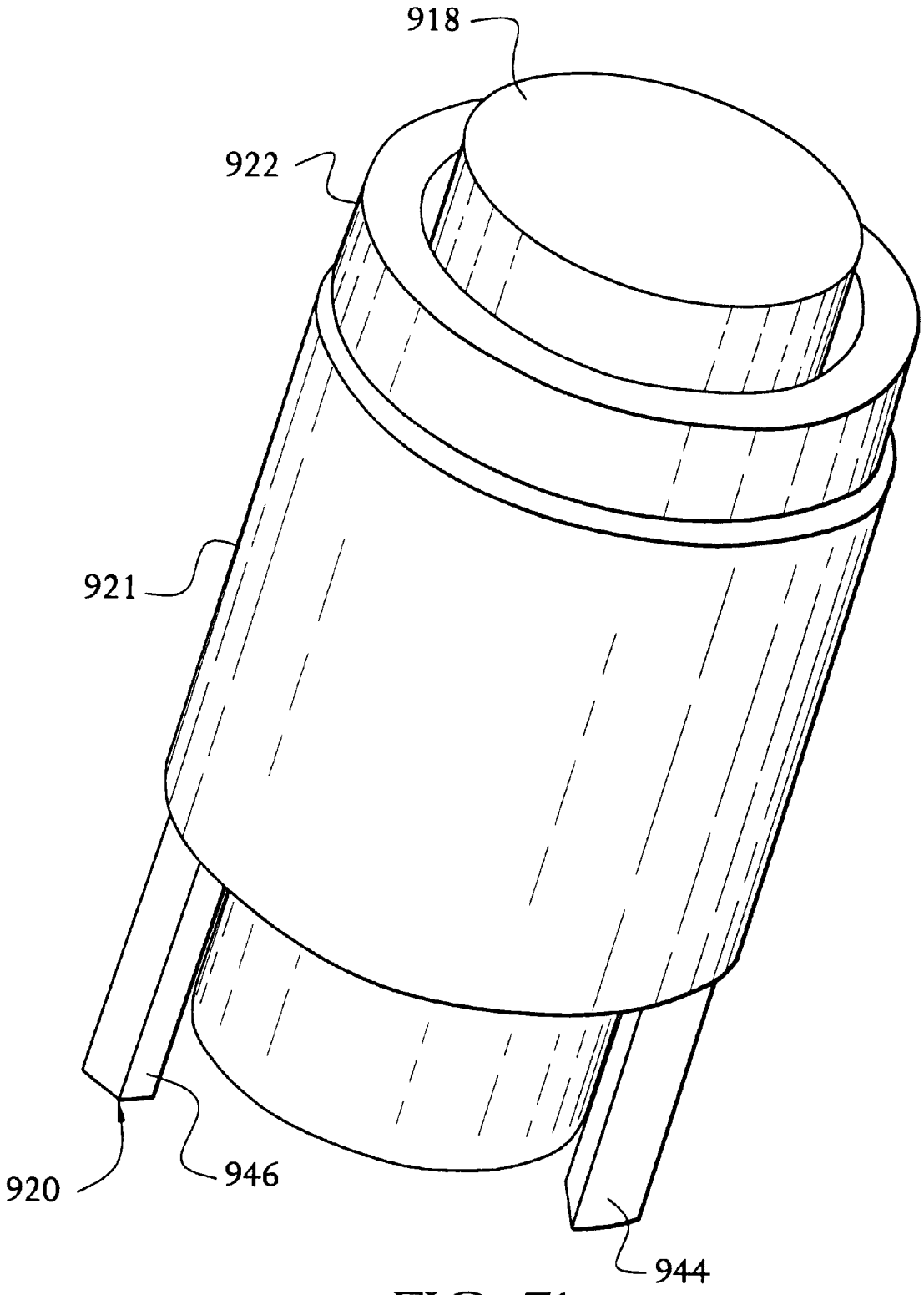
FIG. 51 is a fragmentary section front elevational view of a latch in accordance with another of the present invention.

Another embodiment of the present invention is illustrated in FIGS. 51–54. The latch in accordance with the present embodiment illustrates a modified arrangement for securing the handle assembly when retracted to its closed position. For the sake of brevity, the present embodiment will be described with reference to the latch 10 and only those portions which are different in the present embodiment will be described herein. In accordance with the present embodiment, in FIG. 51 is shown a latch actuating member comprising a can or sleeve 920, and handle 918 and a cam sleeve 921, the details of which will be described in more detail below.

Figure 52:
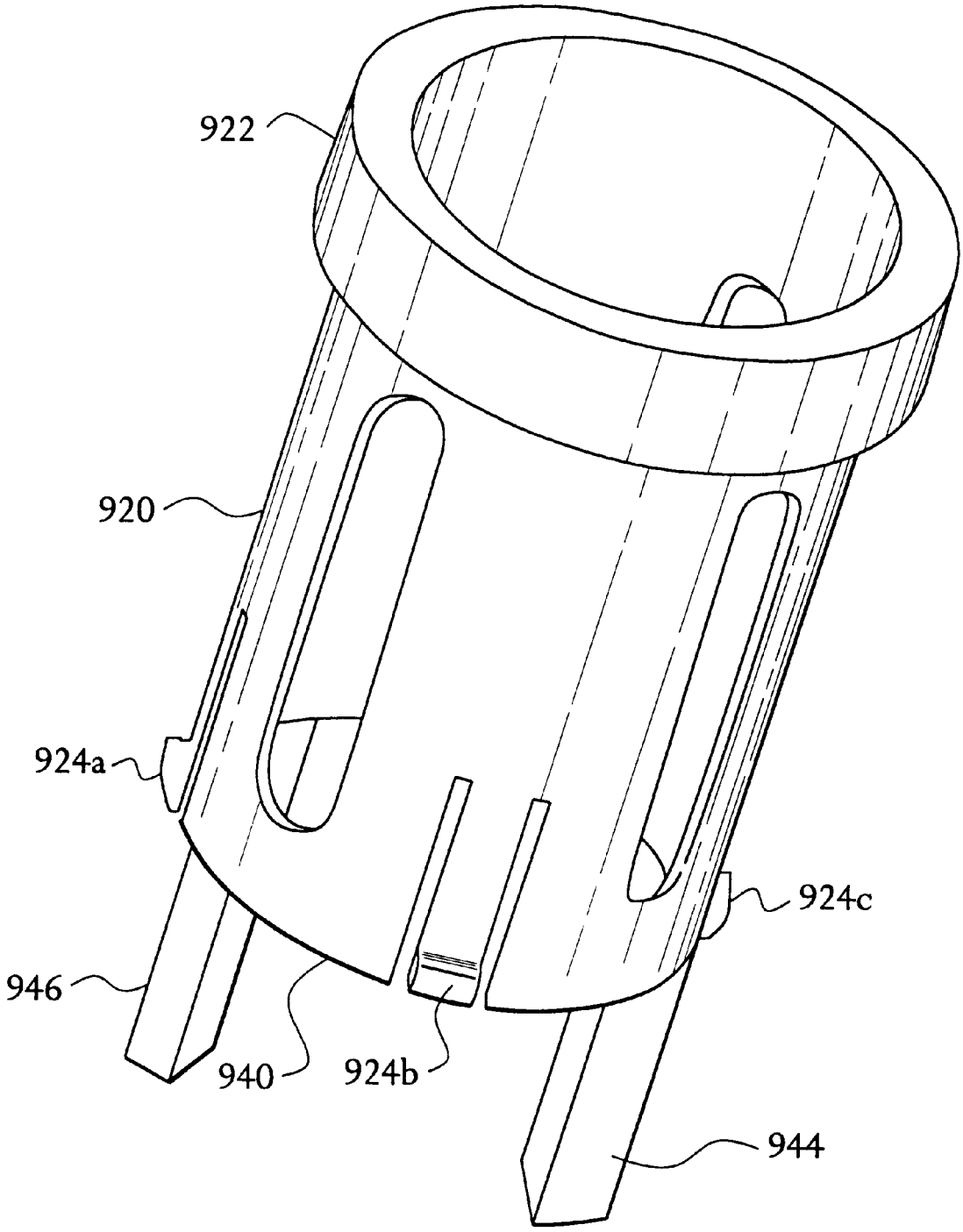
FIG. 52 is an isolated perspective view of a can in accordance with the latch of FIG. 51.

An isolated perspective view of the can 920 is shown in FIG. 52. In this embodiment, the can 920 is a hollow tubular member having an upper flange 922, elongated slots extending along a longitudinal axis corresponding to the slots 60*a*–60*d* in latch 10 and at least one and preferably four substantially flexible tabs 924*a*–924*d* (only three of which are visible) positioned at the bottom end 940 and each including at their distal ends a substantially ramped camming surface and a locking surface. In addition, in this embodiment the can 920 further includes one and preferably two drive members comprising bosses 944 and 946, corresponding to the bosses 44 and 46 of the can 20.

Figure 53:
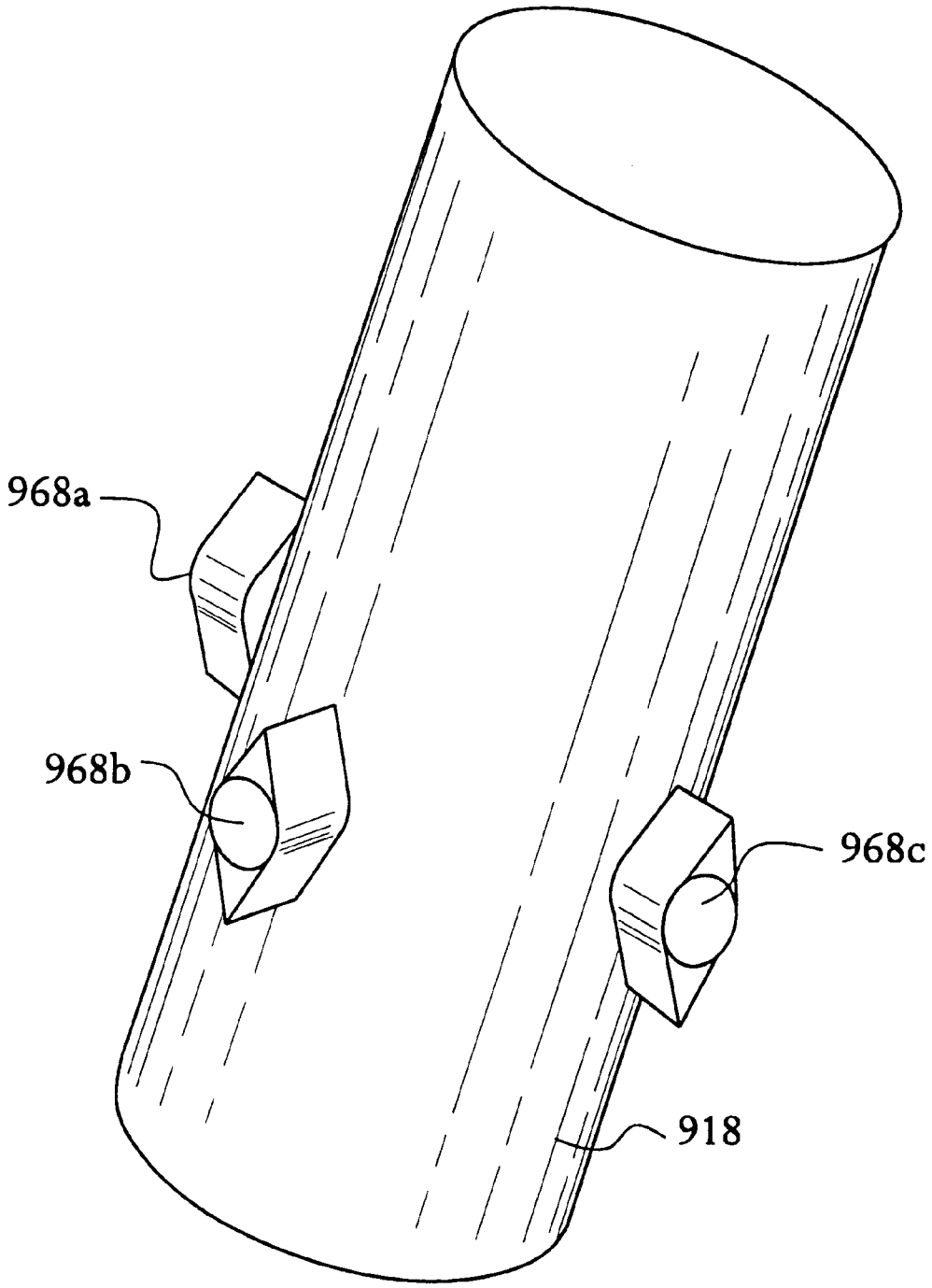
FIG. 53 is an isolated perspective view of a handle of FIG. 51.

The handle 918 in the present embodiment is illustrated in the isolated perspective view of FIG. 53. The handle 918 in this embodiment is generally cylindrical in configuration having at least one and in this embodiment preferably four bosses 968*a*–968*d* (only three of which are visible) extending from the outer surface of the handle 918. The bosses 968*a*–968*d* in this embodiment are preferably substantially diamond shaped in configuration, although any suitable configuration can be utilized where desired.

Similar to the latch 10, the handle 918 and can 920 are assembled together by the bosses 968*a*–968*d* being inserted through the elongated slots through the outer surface of the can 920.

Figure 54:
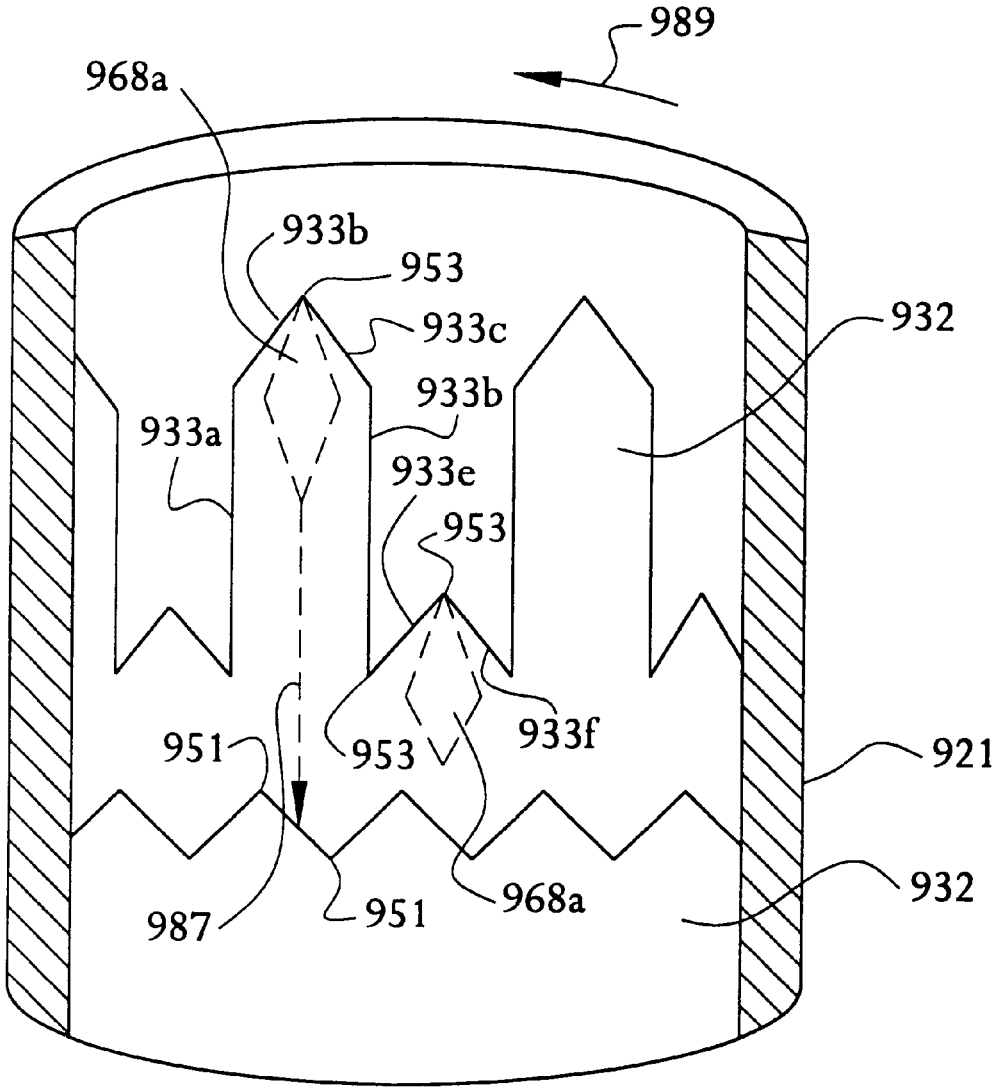
FIG. 54 is an isolated sectional view of a cam sleeve of FIG. 51.

The cam sleeve 921 in the present embodiment is a generally tubular member surrounding the handle 918 and can 920 in the present embodiment. An isolated front sectional view of the sleeve 921 of the present embodiment is illustrated in FIG. 54. The sleeve 921 includes a cam channel 931 provided within at least a portion of and preferably continuous around the inner surface 932. In this embodiment, the cam channel 931 is only partly within the inner surface 932, however, where desired the cam channel 931 can extend entirely through the wall of the cam sleeve 921 when desired. In the present embodiment, the cam channel 931 is a two dimensional cam surface and in the form of a pattern defined by upper and lower portions. In this embodiment, the pattern of the upper portion is defined by a first surface 933*a* extending substantially along the longitudinal axis of the cam sleeve 921, an inwardly ramped second surface 933*b*, an outwardly ramped third surface 933*c*, a fourth surface 933*d* substantially parallel the first surface 933*a*, an upwardly ramped fifth surface 933*e* and a downwardly ramped sixth surface 933*f*, at which point the pattern starts over again with 933*a*. The lower portion of the cam channel 931 in this embodiment is defined by alternating upwardly inclined and downwardly inclined cam surfaces which in combination are generally saw-tooth in shape. In addition, in this embodiment the point of intersection between the upwardly inclined and downwardly inclined cam surfaces, such as illustrated at points 951 in the lower portion of the cam channel 931, are offset with respect to the corresponding points of connection between the upwardly and downwardly inclined cam surfaces of the upper portion of the cam channel 931, such as at 953. In the present embodiment, the cam sleeve 921 is assembled by being inserted around the can 920 from the direction of the bosses 944 and 946 and secured in position between flange 922 and the tabs 924*a*–924*d*. In particular, similar to the tabs 68*a*–68*d* of the latch 10, the tabs 924*a*–924*d* initially are flexed inward due to the engagement with the inner surface 932 of the sleeve 921, with the tabs 924*a*–924*d* flexing back toward their original position, and with the locking surfaces engaging the lower surface of the cam sleeve 921, when the cam sleeve is in its assembled position. In this embodiment, preferably each of the bosses 968*a*–968*d* of the handle 918 are positioned within the cam channel 931 of the cam sleeve 921.

The operation of the latch actuating member in accordance with the present embodiment will now be described. In operation, similar to latch 10, the handle 918 can be depressed between extended and retracted positions when mounted within a housing, such as the housing 14. In the present embodiment, the motion of the handle 918 between its extended and retracted position is regulated by the engagement of the bosses 968*a*–968*d* within the cam channel 931 through the cam sleeve 921. In this embodiment, the rotational position of the handle 918 is substantially fixed when positioned within the housing, while the axial translation of the handle 918 is regulated via the engagement between the bosses 968*a*–968*d* within the longitudinal slots within the can 920. In this embodiment, while not shown, a compression spring is preferably provided for urging the handle 918 towards its extended position, and the extended position of the handle 918 is maintained by the position of the bosses 968*a*–968*d* within the upper camming surfaces 933*b* and 933*c*, such as illustrated in dotted lines in relation to the boss 968*a*. Subsequent depression of the handle 918 will result with the bosses 968*a*–968*d* being moved in a downward direction toward the lower portion of the camming channel 931, such as in the direction of arrow 987 with respect to the boss 968*a*, and which comes into engagement with the downwardly sloped cam surface of the lower portion and in turn forces the cam sleeve 921 to rotate in a counter-clockwise direction in the direction of arrow 989. In this manner, the handle 918 is retained in its retracted closed position due to the position of the bosses 968*a*–968*d* within the lower cam surfaces 933*e* and 933*f*, such as illustrated in dotted lines by the boss 968*a*. In this manner, subsequent movements of the handle 918 between the extended and retracted positions results with corresponding rotation of the cam sleeve 921, so that the bosses 968*a*–968*d* can move between the upper and lower camming surfaces 933*b*, 933*c* and 933*e* and 933*f*, respectively. Although not shown, in this embodiment, the latch actuating member would operate in a similar manner as that shown in relation to the latch 10; in particularly by retraction of the pawl via the drive members 944 and 946 upon rotation of the handle 918 when in its extended position.

Figure 55:
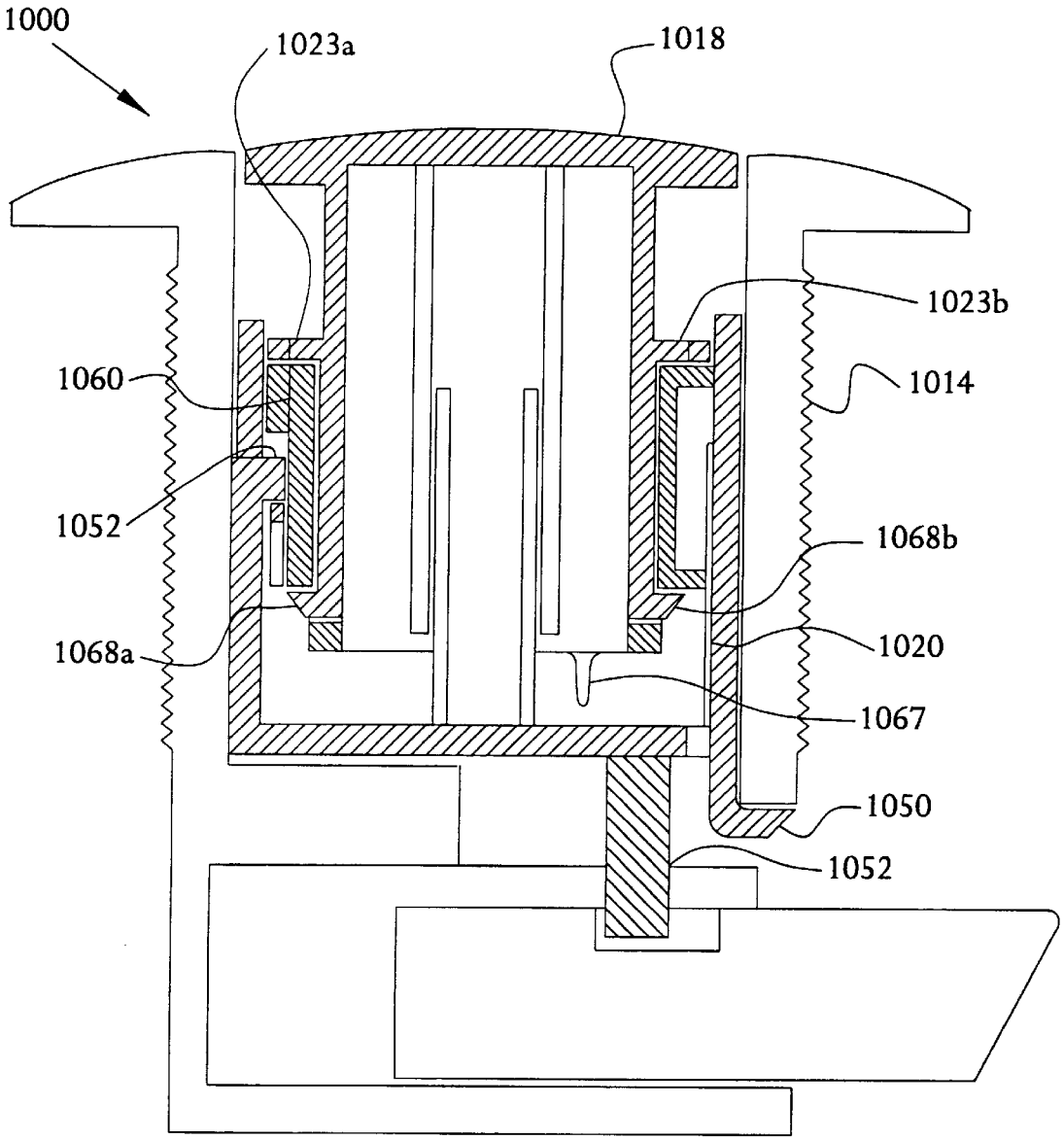
FIG. 55 is a sectional elevational view of a latch in accordance with another embodiment.

In FIGS. 55, 56 and 56*a*–*d* is illustrated another embodiment of a latch in accordance with the present invention. For purposes of this illustration, the latch 1000 illustrated in FIG. 55 is of the slam-action type and similar to the latch 10. In this embodiment, the primary difference from the latch 10 is the means for retaining the handle in the extended and retracted positions within the housing. In the present embodiment, the housing 1018 preferably has an outer surface and at least one and preferably four tabs 1068*a*–1068*d* (only two of which are visible) proximate the end distal the flange, which substantially correspond to the tabs 68*a*–68*d* of the latch 10. In addition, in this embodiment, the handle 1018 also includes at least one and preferably four substantially resilient stops 1023*a*–1023*d* (only two of which are visible) extending from the outer surface and at spaced separation from the tabs 1068*a*–1068*d*.

The can 1020 in this embodiment includes a boss 1050 for engagement with the housing 1014, at least one and preferably two drive members 1052 extending from its lower surface (only one of which is visible) and at least one boss 1052 extending from its inner surface, the purpose of which will be described below. The boss 1052 in this embodiment is generally cylindrical in cross-section.

Figure 56:
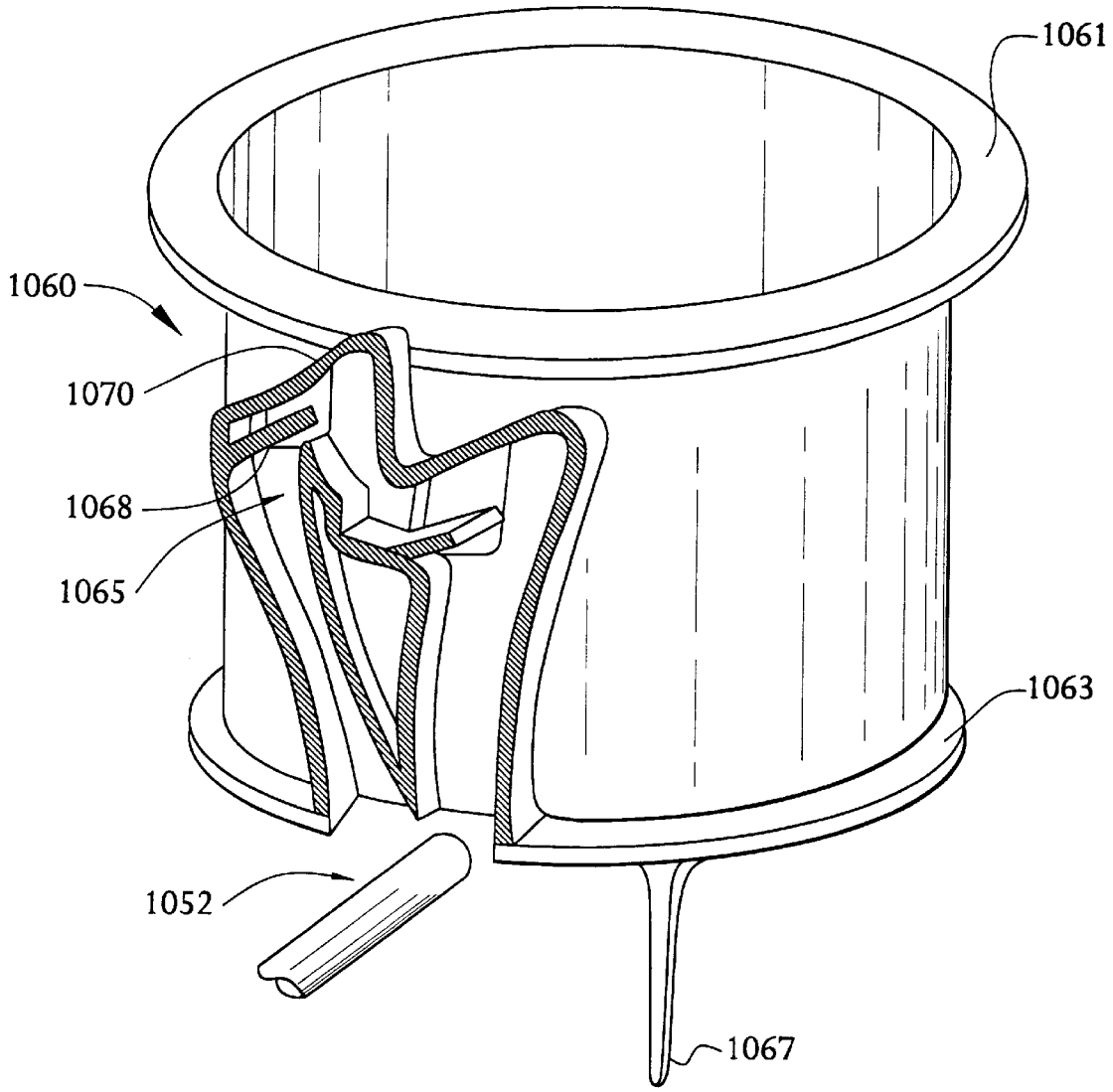
FIG. 56 is an isolated perspective view of a cam sleeve of FIG. 55.
Figure 56:
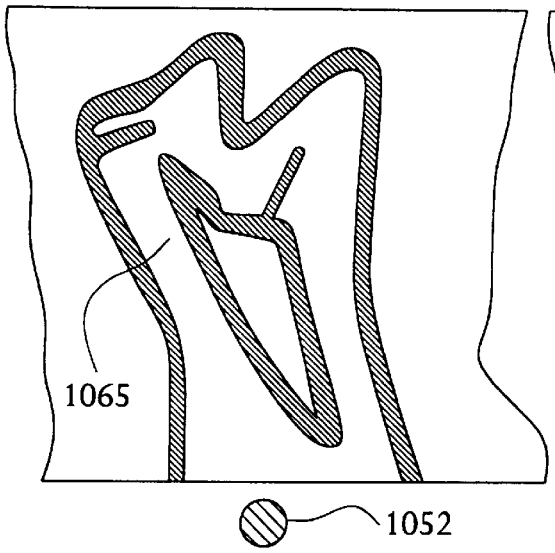

In this embodiment, the latch 1000 also includes a cam sleeve 1060 positioned between the handle 1018 and can 1020, which is best illustrated in the isolated view of FIG. 56. The cam sleeve 1060 in this embodiment is a generally hollow cylindrical member having opposing flanged surfaces 1061 and 1063 and at least one cam surface 1065 in the outer surface of the cam sleeve 1060 into which is received the terminating end of boss 1052 as shown in FIG. 55, which in the present embodiment defines a two dimensional cam surface. In this embodiment, biasing means are preferably provided between the cam sleeve 1060 and can 1020 for centering of the cam sleeve 1060 in the position illustrated in FIG. 55. In this embodiment, the biasing means comprises an integral living spring 1067 extending from the lower flange 1063, although any other suitable configuration can be utilized for the same purpose. As best illustrated in FIG. 56, the cam surface 1065 is generally heart-shaped in configuration. In addition, in this embodiment, the cam surface 1065 may also include at least one and in this embodiment two stop members 1068 and 1070 each in the form of a cantilever spring in this embodiment. The stop members 1068 and 1070 allow the boss 1052 to pass in one direction but not the opposite direction.

Figure 56B:
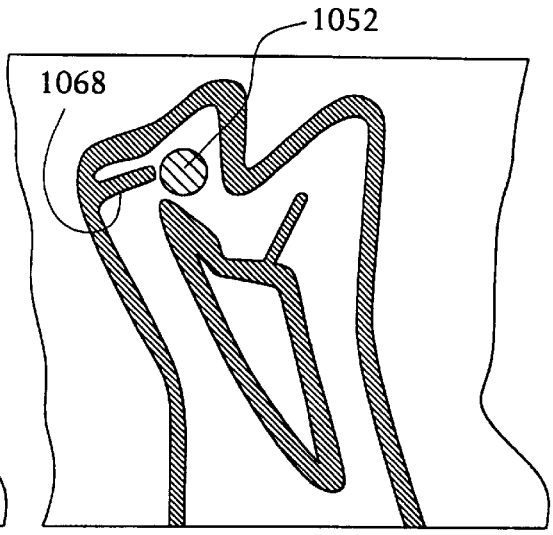
Figure 56C:
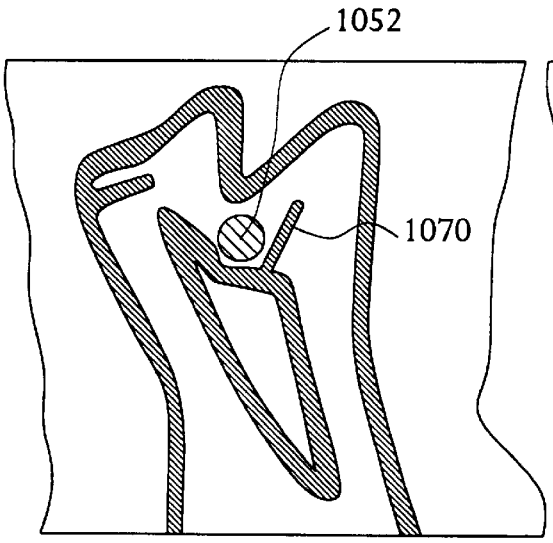
Figure 56D:
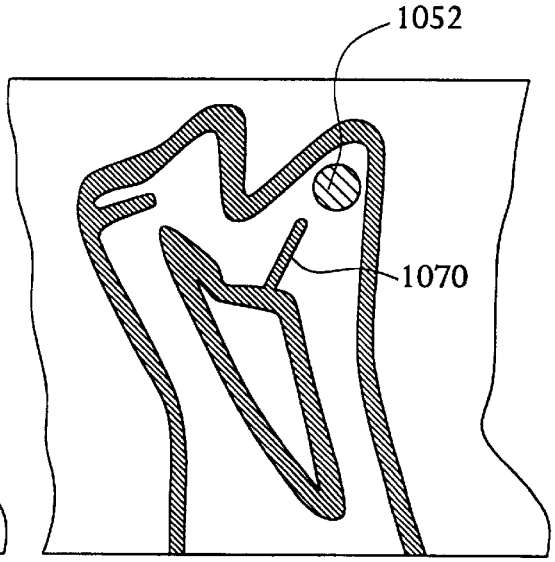

In FIGS. 56*a*–56*d* is illustrated the position of the boss 1052 in relation to the cam surface 1065 as the handle 1018 is moved between its extended and retracted positions. In FIG. 56*a*, the boss 1052 is outside of the cam surface 1065 when the handle 1018 is in its extended position. FIG. 56*b* shows the position of the boss 1052 just past the cantilever spring 1068 when the handle 1018 is in its transition being moved toward its retracted closed position. FIG. 56*c* illustrates the position of the boss 1052, which is adjacent and preferably against the cantilever spring 1070, when the handle 1018 is in its closed position. FIG. 56*d* shows a position of the boss 1052 just past the cantilever spring 1070 when the handle 1018 is in its transition after being depressed moving towards its extended position. The boss can be a generally flexible member to accommodate travel through the cam surface 1065, and/or the cam sleeve 1060 can be moveable relative to the can 1020, such as rotatable, for this same purpose.

The operation of the boss 1052 is thus as a cam follower with respect to the cam surface 1065 provided within the cam sleeve 1060. In this embodiment, the cam follower 1052 is provided on the can 1020, although the cam follower 1052 can be provided on any other device where desired, such as the handle 1018. In addition, in the present embodiment the cam surface 1065 is provided on the cam sleeve 1060 and which is generally annular in configuration, although in other embodiments the cam sleeve 1060 can be provided in other configurations as well, such as planer, or the cam surface 1065 can be provided in other devices as well. The remaining portions and operation of the latch 1000 is similar to that described with respect to the latch 10 and will not be described in more detail herein for this reason.

Figure 57:
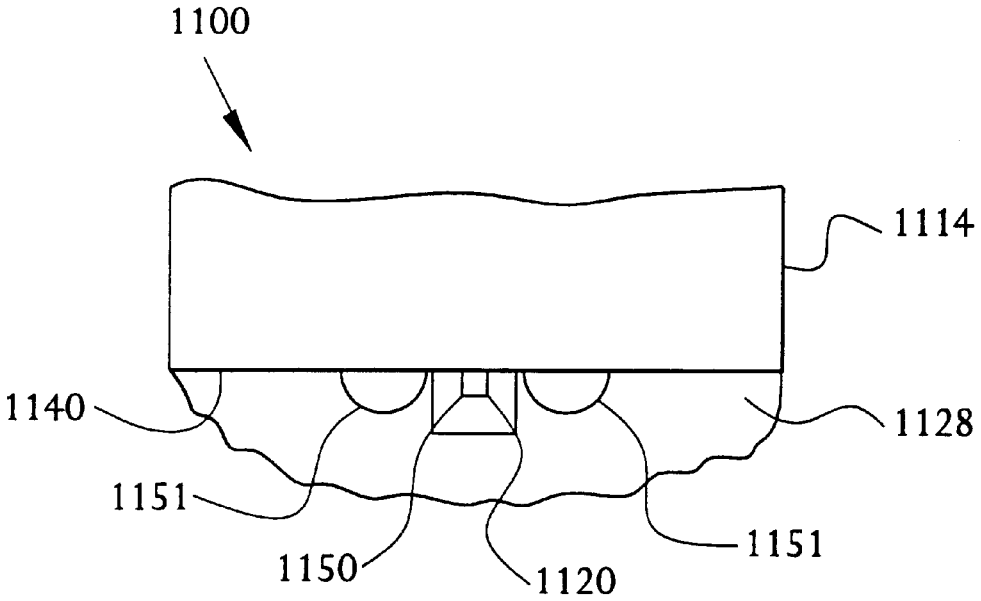
FIG. 57 is a fragmentary front elevational view of a latch in accordance with another embodiment of the present invention.

Another embodiment of the latch in accordance with the present invention is shown in FIG. 57. As indicated earlier with respect to the earlier embodiments of the present invention, for the sake of brevity, only the portions which differ from the earlier embodiments will be described in detail herein. The latch 1100 in accordance with the present embodiment comprises detent means which operates to assist in centering of the handle and which also helps to preferably prevent or at least limit wobble in the latch. For purposes of this illustration, the latch 1100 in the present embodiment will be described with reference to the slam latch 10. In the present embodiment, the detent means is provided between the housing 1114 and can 1120 as will be described in detail below, although it should be understood that the detent means can be provided between other portions of the latch, such as the handle and the housing. For purposes of this illustration, a fragmentary front elevational view of the latch 1100 is shown in FIG. 57. In the present embodiment, the only portion differing from that illustrated with respect to the slam latch 10 is the housing 1114. As shown in FIG. 57, at least one and preferably two detents 1151, which in the present embodiment comprise two bosses, are attached to the housing 1114 proximate the wall 1140. In this embodiment, the detents 1151 are attached at the wall 1140 and extend into the opening 1128 of the housing 1114. The detent feature of the present invention includes the boss 1150 of the can 1120, which corresponds to the boss 50 of the slam latch 10. In operation of the latch 1100, on clockwise or counter clockwise rotation of the handle, the boss 1150 of the can 1120 will contact and ride over the detent 1151 when the handle is moved back to its center position. As shown in FIG. 57, the boss 1150 is positioned between the detent 1151 when the handle is in its center position. The position of the boss 1150 between the detents 1151 operate to reduce wobble of the latch. In addition, the detents 1151 provide a "feel" of when the handle is centered due to the boss 1150 passing over the detents 1151 when the handle is rotated in order to unlatch the device. In the present embodiment, the sloped cam surfaces on the top of the boss 1150 facilitate the motion of the boss 1150 past the detents 1151. As should be understood, the detent feature of the present embodiment can be utilized with any of the other embodiments, just as any of the other features of the present invention shown in the various embodiments can be incorporated alone or in any desired combination in accordance with the scope and spirit of the present invention.

In view of that set forth above, it should be understood that there are several advantages of the present invention. One particular advantage is that the various features which are disclosed within a latch of the slam-action type can be applied to other types of latches as well, such as those having a rotatable pawl. Similarly, the features of the actuator 310 can also be used with other varieties of latches.

Another advantage of the present invention is that it discloses a retractable action of the handle, which provides a low-profile and is snag-resistant while still providing the user with ample purchase when extended to operate the latch and open the door; for example, in the slam latch 10 and actuator 310, the handle is positioned substantially flush with the outer surface of the housing when in its retracted position. In addition, the action of the handle provides for improved security in that the latch will remain in its secured position against the keeper even if the handle should inadvertently be actuated to move to its extended position, such as inadvertent contact or vibration. In addition, the action of the handle shown in the slam latch 10 provides a more versatile latch in that the handle can be maintained in its extended position while being latched where desired, such as where a door may be repeatedly opened so that easier access to the handle is desired.

Another advantage to the present invention is that the generally flexible leg connected to the can in the slam latch 10 operates to hold the handle it its stowed position. In addition, the action of the generally flexible leg on the can and camming surface on the handle accommodates for misalignment while still holding the handle in the stowed position, which is a feature not known to be present in the prior art.

Another advantage of the slam latch 10 is that slam action is possible for latching of the pawl against the keeper when the handle is either in its retracted position or out in its extended position, which allows the operator to stow the handle any time they wish, and then slam the door closed.

Still another advantage of the present invention is the serrations on the pawl and keeper which engage in the latched position. The serrations allow for easy slam closing but still provides significant holding force. The serrations also provide significant tolerance for vibration and misalignment which provides a more secure latching engagement. In addition, the serrations permit the pawl to engage the keeper at any point along its spring-loaded travel path. the sawtooth engagement of the serrations provide a grip range for the latch. This, in turn, provides significant tolerance for misalignment in the Y-direction and a consistent holding force regardless of how far the pawl protrudes. Typical prior art designs require the pawl to engage behind the keeper, so without precise placement of the keeper, the pawl may not engage at all or there could be a gap between the pawl and the keeper resulting in looseness or the pawl may only partially engage the keeper resulting in a reduction of holding force. In addition, another advantage of the serrations on the pawl and keeper is to accommodate for misalignment. In addition, the rounded profile of the pawl and keeper also accommodate for misalignment by allowing rotational misalignment about the longitudinal axis of the latch. On the other hand, typical prior art designs require careful placement of the keeper to properly engage the pawl. Another advantage is that each serration is very small and, where desired, a minimal number of serrations can be utilized and which would almost be invisible to the eye, enhancing the appearance in many applications. In addition, another advantage is that the serration portions can be comprised of plastic, providing non-rusting characteristics and also eliminating the deposit of metal flakes or chips, such as would occur with metallic latching devices, which can be disruptive in the operation of certain equipment, such as special electronic/EDP equipment.

Another advantage of the present invention is the anti-rotation lug on the housing, which simplifies panel preparation by eliminating the need for a mounting hole with flats to prevent unwanted rotation of the door and panel. Typical prior art designs which operate to prevent unwanted rotation incorporate one or more flats into the housing shape and then require a mounting hole prepared in the panel with flats to accept the latch. The design of the anti-rotation lug on the housing allows for preparation of a fast circular hole in the panel followed then by adding a small key way, such as with a file router, to accept the lug.

A further advantage of the present invention is the ability to actuate the pawl from inside and which allows the pawl to be depressed whether the latch is locked or unlocked. This is a safety feature to prevent someone from being trapped inside an enclosure with no means to unlatch the door.

Another advantage of the present invention is the nested, snap together assembly in that the handle component snap fits inside of the can and is retained in the present embodiment by four small tabs and the can has one snap tab in the present embodiment which retains the can inside the housing.

Still another advantage of the present invention is that it is versatile and adaptable for use in a variety of different types of applications, for example, for marine use, such as enclosures used on boats.

As described earlier, while the present invention is described in terms of a slam latch, many modifications and variations are possible and the various features disclosed can be provided individually or in any combination with the same or other types of latches as well. For example, although not shown, a lock plug can be incorporated into the design of the latch in order to operate between locked and unlocked positions. As an example, a lock plug can be incorporated into the handle. Also, a gasket can be provided around the housing to engage the lower surface of the flange and surface of the panel member when the latch is mounted. In addition, another possible modification is to provide one or more generally elongated bosses or "arms" extending from the handle so as to engage and retract the pawl on rotation of the handle rather than the bosses extending from the can. Also, where the bosses would be provided on the handle, one or more holes can be provided in the housing into which the bosses would extend when the handle is in the closed or retracted position. In addition, another change can reverse the positions of the leg on the can and the camming surface on the handle so that the leg is provided as part of the handle and the camming surface is provided as part of the can. Alternatively, in other modifications, the can may be eliminated and the leg incorporated as part of the housing and, as noted above, with the function of the two bosses extending from the can taken up by a corresponding feature on the handle or the coil spring attached with the handle which can have its free end extend to engage the pawl. Still another modification is to have an integral or separate portion in place of the generally flexible leg on the can and a spring for biasing that portion. Also, the handle can be provided of any desired configuration, such as a knob, T-handle, etc. In addition, still another modification is to provide the pawl as one-piece with the handle. Another modification is to incorporate a conventional pawl and keeper, such as shown in the '464, '874, '152 and '769 patents. Still another modification is to provide a self-aligning feature between the pawl and housing, which assists in alignment of the ratcheting teeth on the pawl with the ratcheting teeth on the keeper. Two embodiments illustrating this modification are shown in FIGS. 15–18 in relation to the slam latch 10. In one embodiment, at least one and preferably two channels 410 each generally square in cross-section are provided within the pawl 416 extending along its longitudinal axis and which receives two generally elongated bosses 412 also generally square in cross-section extending from the housing 414 and positioned within the opening 428. In the present embodiment, preferably the size of a gap defined by opposing surfaces 415 of the channels 410 along an axis substantially perpendicular to the longitudinal axis of the pawl 416 is larger than a diameter of the housing 412 along that same direction. In operation, the pawl 416 is able to rotate in either a clockwise or counterclockwise direction due to the space between the bosses 412 and the surfaces 415 of the channels 410. In another embodiment shown in FIGS. 17 and 18, the positions of the channels 510 and bosses 512 are reversed and positioned on the housing 514 and pawl 516, respectively. As described earlier, another modification is that the feature of serrations on the keeper and latch can be provided with other types of latches as well. In addition, while the slam latch 210 is shown incorporating an actuator having an external handle, the actuator can also be provided with a recess such as a finger engaging recess for moving of the slam latch 210 into its unlatched position. In addition, the cap 316 and shell 314 can be connected by any suitable means other than the snap-fit arrangement disclosed; for example, by soldering, adhesive or screw connection to name a few. In addition, where desired, the cap 316 and shell 314 can be provided as a one-piece structure, such as being molded as a single piece. In addition, where desired, the biasing means 322 while disclosed as comprising a metallic coil spring, the biasing means 322 can be of any suitable type, such as a living hinge, for example, attached to the cap 316. Moreover, where desired, the biasing means 322 can be eliminated so that the actuator 310, rather than automatically being moved to its extended position by the biasing means 322, the operator can instead apply a suitable amount of pulling force to move the actuator 310 to its extended position. In addition, the actuator 310 can also include a pawl indicator where desired, for example with the types of latches incorporating a rotating pawl such as the latch 312. Suitable pawl indicators can include, for example, any types of visual indicia, such as lines, arrows and/or wording on the cap 316 and/or the shell 342 in order to indicate the position of the pawl 334 relative to the position of the actuator 310. Furthermore, while in the embodiment disclosed, the housing 324 is generally rectangular in configuration and includes substantially cylindrical extensions 338, which are received within correspondingly configured apertures through the first member 302, and which receive mounting nuts 308 for connection, it should be understood that the housing 324 can be of any desired configuration and include any of a variety of different means for attachment to a member, for example, a mounting nut received onto the generally cylindrical portion of the housing 324. Accordingly, it is understood that the above description of the present invention is susceptible to considerable modifications, changes and adaptation by those skilled in the art, and that such modifications, changes and adaptations are intended to be considered within the scope of the present invention.

We claim:

1. A slam-latch comprising:

a housing;

a pawl proximate said housing for movement between extended and retracted positions;

latch actuating means for selectively moving said pawl in said retracted position, said latch actuating means comprising a handle disposed within said housing for both rotational movement and for movement between extended and retracted positions, said actuating means further comprising a drive member within said housing and attached with said handle for rotational movement corresponding with rotational movement of said handle;

said housing being generally elongated and including an upper surface and a cavity within said upper surface, said drive member comprising a sleeve generally elongated and received within said housing cavity, said sleeve further including an outer surface and top and bottom surfaces with a cavity within said top surface, said handle being generally elongated and defining an outer surface and upper and lower end surfaces, said handle being received into said sleeve cavity in said retracted position of said handle, said sleeve further including at least one actuating boss extending from its bottom surface engaging said pawl on rotational movement of said handle for moving said pawl into its retracted position; and said handle includes at least one boss extending from its outer surface of said sleeve for attachment of said handle and said sleeve, wherein said at least one cavity is generally elongated along a longitudinal axis of said sleeve to accommodate movement of said handle between its extended and retracted positions.

2. A slam-latch according to claim 1, wherein said handle includes a plurality of bosses extending from its outer surface, with each boss defining a camming surface and a locking surface and said sleeve includes a plurality of cavities within said outer surface and extending along a longitudinal axis of said sleeve receiving said plurality of bosses of said handle.

3. A slam latch according to claim 1, wherein said housing includes an outer surface and an opening within said outer surface extending to said cavity within said upper surface, wherein said pawl is received within said opening in said outer surface of said housing, said pawl including an upper surface and at least one wall extending from said upper surface, with said at least one actuating boss on said can engaging said at least one wall of said pawl for moving said pawl into its retracted position.

4. A slam latch according to claim 3, wherein said pawl includes two substantially aligned walls extending from the upper surface thereof and said sleeve includes two actuating bosses extending from its bottom surface, wherein a first boss of said two actuating bosses engages a first wall of said two walls upon clockwise rotation of said handle and a second boss of said two actuating bosses engages a second wall of said two walls upon counterclockwise rotation of said handle.

5. A slam-latch according to claim 3, further including a first biasing means between said handle and said sleeve for urging said handle to its extended position and a second biasing means between said pawl and said housing for urging said pawl to its extended position.

6. A slam-latch according to claim 5, further including means between said handle and said sleeve for retaining said handle in its retracted position.

7. A latch comprising:

a housing;

a latching member;

a latch actuating member for actuating said latching member and associated with said housing for both rotation and axial translation relative to said housing, wherein said housing includes an upper surface and a cavity within said upper surface, said latch actuating member further includes a handle having an outer surface and an upper end surface, wherein said handle is received within said housing cavity for axial translation between extended and retracted positions, with said outer surface of said handle being substantially received within said housing cavity and said upper end surface of said handle being substantially flush with said upper surface of said housing in said retracted position and said outer surface of said handle being substantially outside of said housing cavity in said extended position;

said latch actuating member further includes means for actuating said latching member upon rotation of said handle, said latch actuating means comprises a sleeve within said housing cavity and attached with said handle for rotation corresponding with rotation of said handle;

the latch further comprising means between said sleeve and said handle for attaching said sleeve and said handle, wherein said attaching means comprises at least one boss received within at least one cavity generally elongated along a longitudinal axis of said housing; and said sleeve includes at least one actuating boss engaging said latching member upon rotation of said handle for moving said latching member between latched and unlatched positions.

8. A latch according to claim 7, further comprising biasing means between said sleeve and said handle for urging said handle to its extended position and means between said handle and said sleeve for retaining said handle in its retracted position.

9. A latch according to claim 8, wherein said retaining means comprises a generally flexible leg and an opening receiving said generally flexible leg.

10. A latch according to claim 9, wherein said latching member comprises a biased pawl movable axially between extended and retracted positions on rotation of said handle.

11. A slam latch comprising:

a housing;

a pawl disposed within said housing for movement between extended and retracted positions;

a keeper engaging said pawl in a latched position;

latch actuating means for selectively moving said pawl into said retracted position for unlatching from said keeper, said latch actuating means comprising a handle for movement at least axially between extended and retracted positions, wherein said pawl is moveable at least toward said retracted position of said bawl by engagement with said keeper when said handle is in said extended position thereof and said retracted position thereof for latching of said pawl and said keeper;

said latch actuating means further comprises an actuator for selectively moving said pawl, wherein said actuator is at spaced separation from said pawl when said pawl is moved toward said retracted position of said pawl by engagement with said keeper; and said housing is generally elongated defining an outer surface, opposing upper and lower surfaces, a cavity within said upper surface and an opening within said outer surface extending to said cavity, said pawl being received within said opening in said outer surface of said cavity, said actuator comprising a sleeve generally elongated and received within said housing cavity, said sleeve having an outer surface, said handle being generally elongated and defining an outer surface and upper and lower surfaces, said handle being received within said sleeve cavity in said retracted position of said handle, said slam-latch further comprising means between said sleeve and said handle for attaching said sleeve and said handle, wherein said attaching means comprises at least one boss received within at least one cavity generally elongated along a longitudinal axis of said housing.

12. A slam-latch according to claim 11, wherein said handle includes a plurality of bosses extending from its outer surface, with each boss defining a camming surface and a locking surface and said sleeve includes a plurality of cavities within said outer surface and extending along a longitudinal axis of said sleeve receiving said plurality of bosses of said handle.

13. A slam-latch according to claim 11, wherein said pawl includes an upper surface and at least one wall extending from said upper surface and said sleeve includes at least one actuating boss extending from said bottom surface, wherein said at least one actuating boss is moved by rotation of said sleeve through rotation of said handle so as to engage said at least one wall for moving said pawl into its retracted position.

14. A latch, comprising:

a housing;

a pawl associated with said housing for movement between latched and unlatched positions;

a handle associated with said housing for at least one of substantially axial translation or rotation relative to said housing, said handle including drive means for selectively moving said pawl into said unlatched position;

said housing defining an outer surface, opposing upper and lower surfaces and an opening within said outer surface into which said pawl is received for movement between extended and retracted positions, wherein said supplemental latch actuating means comprises a second opening within said outer surface of said housing and an actuating member positioned within said second opening and attached with said pawl; and said latch further comprising connector means for attaching said actuating member to said housing and a receptacle within said pawl, whereby application of force on said actuating member substantially releases attachment of said actuating member and said housing by said connector means and said actuating member is received into said receptacle in said pawl.

15. A slam-latch according to claim 14, wherein said second opening is within said lower surface of said housing, said actuating member when attached to said housing is substantially aligned with said pawl in its extended position, and said actuating member is generally elongated and press-fit within said pawl receptacle on application of force upon said receptacle.

16. A latch comprising:

a housing;

a pawl associated with said housing for movement between latched and unlatched positions;

a sleeve with said housing for moving said pawl into at least the unlatched position;

a handle with said sleeve for actuating said sleeve for moving said pawl;

wherein said latch further comprises connecting means between at least one of said housing and said sleeve or said sleeve and said handle for snap-fit attachment; said connecting means comprising at least one boss and at least one cavity into which said at least one boss is received; and said handle is generally elongated and defines an outer surface and upper and lower surfaces, said sleeve is generally elongated and defines an outer surface and top and bottom surfaces with a cavity within said top surface, wherein said handle is received within said sleeve cavity, said at least one boss is attached with said outer surface of said handle and said at least one cavity is within said outer surface of said sleeve.

17. A latch according to claim 16, wherein said at least one cavity is generally elongated along a longitudinal axis of said sleeve to accommodate movement of said handle along said longitudinal axis between retracted and extended positions.

18. A latch according to claim 17, wherein said handle includes a plurality of bosses extending from its outer surface, with each boss defining a camming surface and a locking surface and said sleeve includes a plurality of cavities within said outer surface and extending along a longitudinal axis of said sleeve receiving said plurality of bosses of said handle.

19. A latch according to claim 16, wherein said housing is generally elongated and includes an outer surface and upper and lower surfaces, with a cavity within said upper surface, said sleeve is generally elongated defining an outer surface and top and bottom surfaces, wherein said sleeve is received within said housing cavity, said at least one boss extends from said outer surface of said sleeve and said cavity is within said outer surface of said housing.

20. A latch according to claim 19, wherein said at least one boss includes a camming surface and a locking surface and said cavity within said housing defines a generally elongated channel into which said at least one boss is moved corresponding with rotation of said sleeve through rotation of said handle.

21. A latch comprising:

a housing;

a latching member associated with said housing;

a handle mounted with said housing for movement at least between extended and retracted positions and for actuating said latching member; and means between said housing and said handle for retaining said handle at least in its retracted position comprising a leg and a receptacle receiving said leg, said receptacle receiving said leg comprising a cam surface.

22. A latch according to claim 21, further comprising a sleeve attached with and responsive to movement of said handle for actuating said latching member.

23. A latch according to claim 22, wherein said leg is attached with said sleeve and said cam surface comprises a three dimensional cam channel and is within said handle.

24. A latch according to claim 23, wherein said sleeve is generally elongated defined by an outer surface and top and bottom surfaces, with a cavity within said top surface, said sleeve further including an opening within said outer surface, wherein said flexible leg is generally elongated and attached at one end thereof to said outer surface of said sleeve and is positioned substantially within said opening within said outer surface thereof.

25. A latch according to claim 24, wherein said handle is received within said sleeve cavity for movement between said extended and retracted positions and said generally flexible leg includes a boss at its free end for engaging said camming surface of said handle in the retracted position thereof.

26. A slam latch comprising:

a housing;

a pawl proximate said housing for movement between extended and retracted positions, said pawl having at least one serration proximate a terminating end;

latch actuating means for selectively moving said pawl into said retracted position, said latch actuating means comprising a handle disposed within said housing for both rotational movement and for movement between extended and retracted positions and drive means comprising at least one drive member for selectively moving said pawl in response to movement of said handle;

a keeper defining a latching surface having at least one serration therein for engagement with said at least one serration of said pawl in a latched position;

wherein said housing includes an upper surface and a cavity within said upper surface, said handle of said latch actuating means further having an outer surface and an upper end surface, wherein said handle is received within said housing cavity for axial translation between extended and retracted positions, with said outer surface of said handle being substantially received within said housing cavity and said upper end surface of said handle being substantially flush with said upper surface of said housing in said retracted position, and said outer surface of said handle being substantially outside of said housing cavity in said extended position;

said slam latch further comprising supplemental latch actuating means independent of said handle and said at least one drive member for selectively moving said pawl into said retracted position, wherein as said pawl is moved into said retracted position by said supplemental latch actuating means, said handle is substantially stationary, wherein said pawl is moveable by said supplemental latch actuating means into said retracted position of said pawl when said handle is in said extended position thereof and said retracted position thereof; and means between said housing and said handle for retaining said handle in its retracted position comprising a generally flexible leg and an opening receiving said generally flexible leg.

27. A slam latch according to claim 26, wherein said latch actuating means further comprises a sleeve attached with said housing and said handle for moving said pawl into at least the retracted position, wherein said slam latch further comprises connecting means between at least one of said housing and said sleeve or said sleeve and said handle for snap-fit attachment.

28. A slam latch according to claim 26, further comprising a first member having an aperture therethrough and mounting means between said outer surface of said housing and said first member adjacent said aperture for substantially retaining a rotational position of said latch relative to said first member, said mounting means comprising a cavity and a protrusion received in said cavity.

* * * * *